US010336584B2

(12) United States Patent
DeBattiste

(10) Patent No.: US 10,336,584 B2
(45) Date of Patent: Jul. 2, 2019

(54) LIFTING AND TRANSPORTING SYSTEM

(71) Applicant: Larry R. DeBattiste, Enfield, NH (US)

(72) Inventor: Larry R. DeBattiste, Enfield, NH (US)

( * ) Notice: Subject to any disclaimer, the term of this patent is extended or adjusted under 35 U.S.C. 154(b) by 51 days.

(21) Appl. No.: 15/609,072

(22) Filed: May 31, 2017

(65) Prior Publication Data

US 2017/0260027 A1 Sep. 14, 2017

Related U.S. Application Data

(63) Continuation-in-part of application No. PCT/US2016/018875, filed on Feb. 22, 2016, and a continuation-in-part of application No. 14/629,927, filed on Feb. 24, 2015, now Pat. No. 9,694,936.

(51) Int. Cl.
*B66F 3/46* (2006.01)
*B66C 1/12* (2006.01)
*B66F 3/24* (2006.01)

(52) U.S. Cl.
CPC ..... *B66C 1/12* (2013.01); *B66F 3/24* (2013.01); *B66F 3/46* (2013.01)

(58) Field of Classification Search
CPC . B65D 19/40; B65D 19/42; B66F 3/36; B66F 3/24; B66F 3/46; B66C 1/12
USPC ..... 52/270, 271
See application file for complete search history.

(56) References Cited

U.S. PATENT DOCUMENTS 3,138,398 A * 6/1964 Silverman ..... B65D 88/528 108/55.1
4,630,550 A * 12/1986 Weitzman ..... A47B 13/06 108/155
4,961,680 A * 10/1990 Riedl ..... B65D 90/143 220/1.5
5,590,974 A * 1/1997 Yang ..... A47B 47/005 403/171
6,168,031 B1 * 1/2001 Schmidt ..... A47B 88/00 211/182

* cited by examiner

*Primary Examiner* — Jonathan Snelting
(74) *Attorney, Agent, or Firm* — Jeffrey E. Semprebon

(57) ABSTRACT

Jack units attach skates to an object to be moved. Each jack unit has a tongue that slidably engages a coupling slot affixed to the object, and can be operated to raise or lower the tongue; when raised, the object is supported on the skates and can be rolled to a new location. A crane can attach to lift eyes on the jack units to allow the system to be lifted with the skates attached to the object, avoiding the risk to operators of positioning the skates under the object while it is suspended. Rotation-limiting structures can be selectively employed to block rotation of the trailing skates to facilitate steering when rolling the object supported by the system. The coupling slots can be provided in coupling elements which can attach directly to the object or which can be employed to form a freestanding frame to which the object is secured.

22 Claims, 21 Drawing Sheets

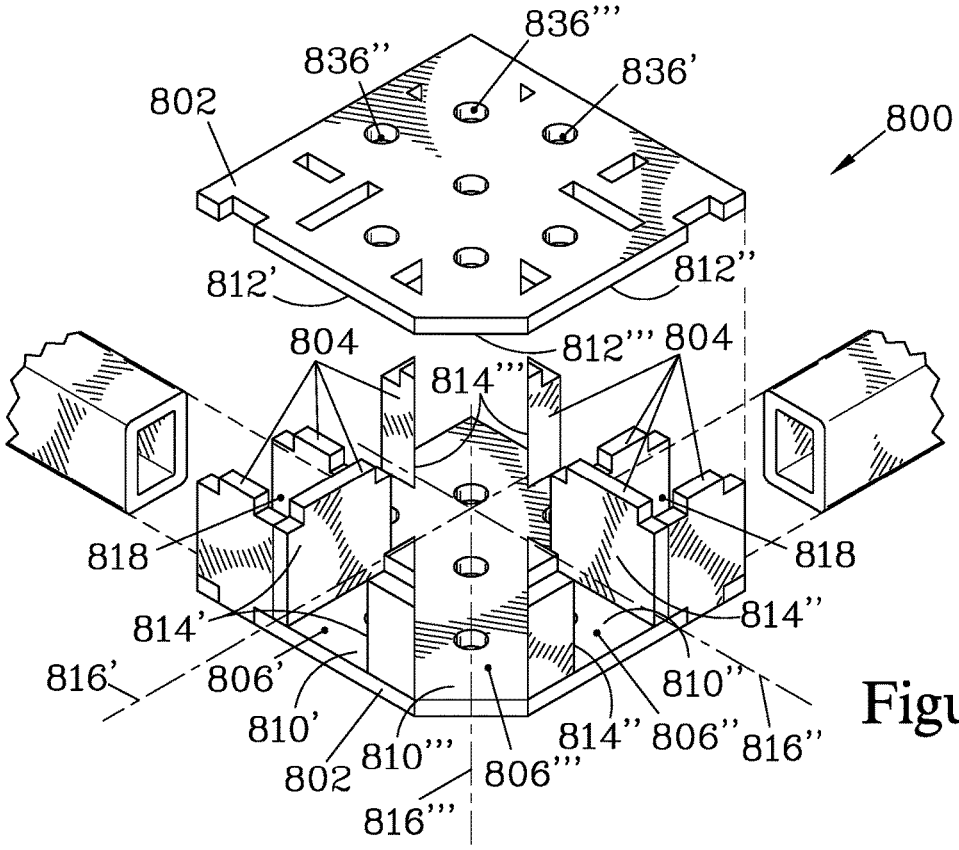
Figure 29
Figure 30
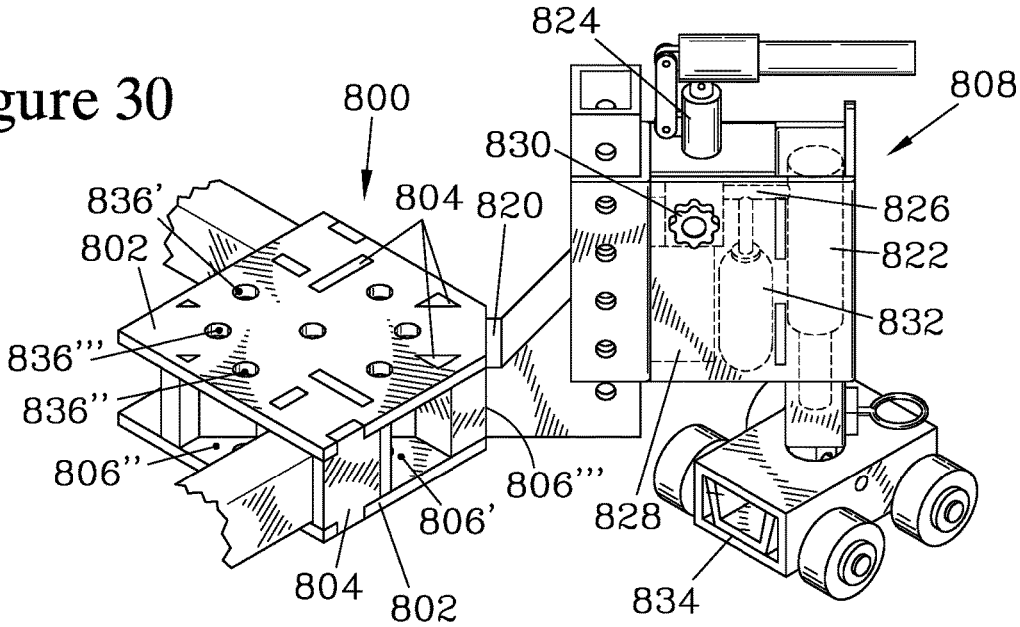

Figure 31
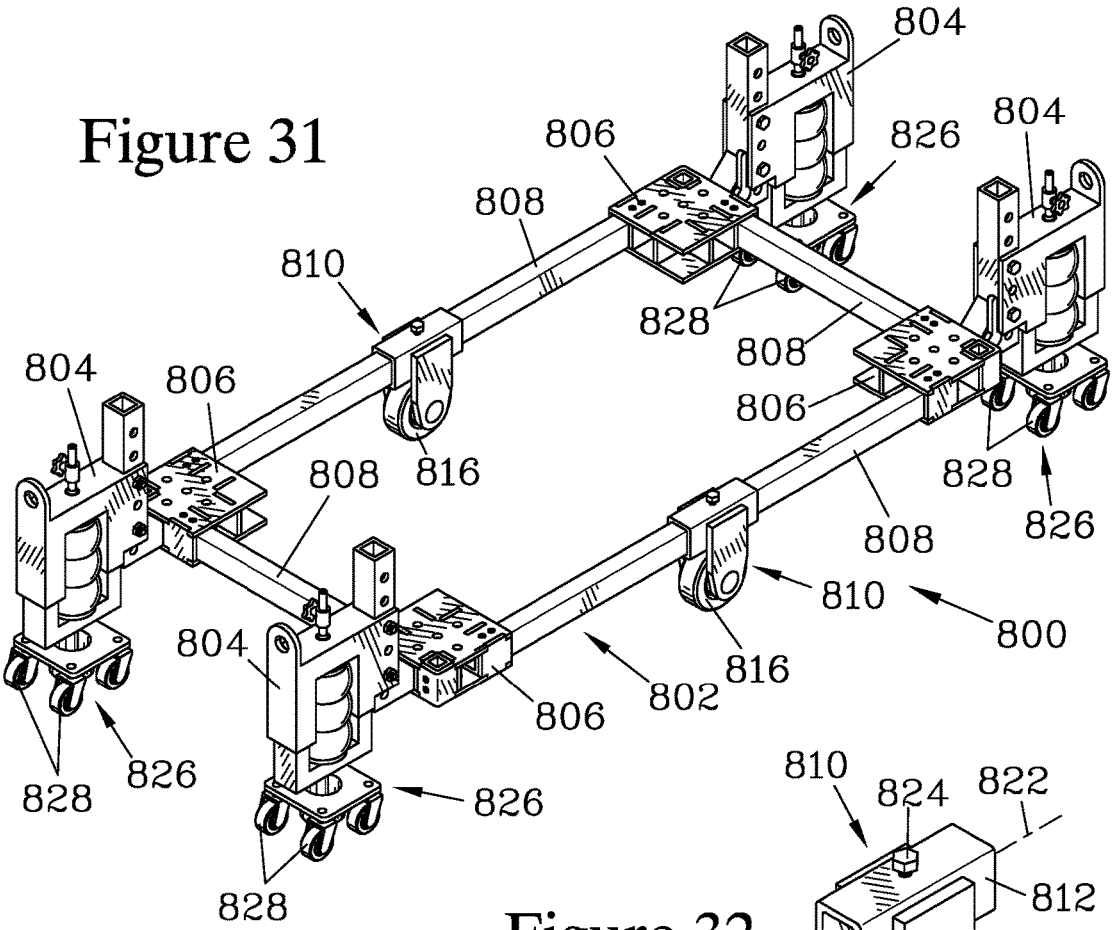
Figure 32
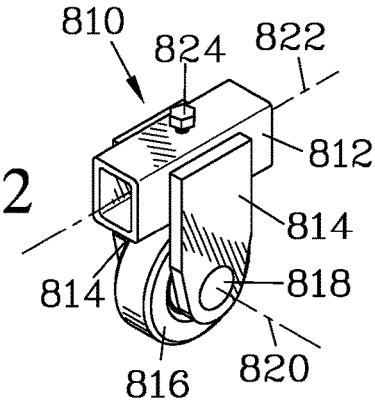
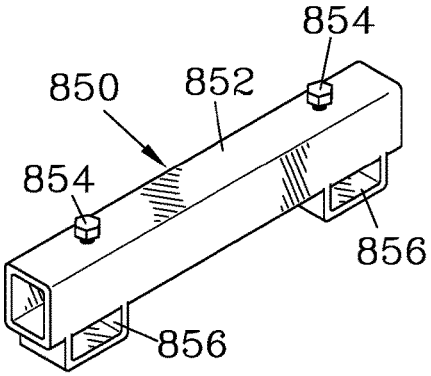
Figure 33
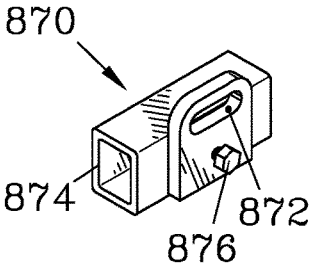
Figure 34

LIFTING AND TRANSPORTING SYSTEM

TECHNICAL FIELD

The present system relates to the field of lifting and transporting loads that are too bulky and/or massive to be readily moved without mechanical aid.

BACKGROUND ART

To move objects that are too large and/or heavy to be placed onto a cart, skid, or similar device, it is frequently necessary to lift the object and place skates or rollers (hereinafter simply referred to as "skates") under the object to support its weight and to allow it to be rolled across a surface to a new location. Such movement causes risks of injury to the movers and damage to the object if the object slips and becomes disengaged from one or more of the skates as it is transported. An additional risk of injury occurs when an object is lowered from a crane onto skates, as moving personnel must work in close proximity to the suspended object in order to position the skates under the object. There is a need to reduce such injury risks to provide greater safety for persons moving large and heavy objects, as well as to reduce the risk of damage due to accidents while such objects are being moved.

SUMMARY OF INVENTION

The present invention provides a lifting and transporting system for safely moving large and/or heavy objects. The system employs a number of jack units, each of which serves to releasably but securely attach a skate, roller, or similar device (hereinafter simply referred to as a "skate") to the object and to retain the skate connected to the object throughout the moving procedure. The jack unit allows the object to be lifted off of the underlying surface so as to be supported on the skate and thereafter moved to a new location. Once positioned, the object can be lowered so that the skate may be removed. The system can be designed such that the jack units are compact and lightweight enough to be readily positionable by an individual operator. Calculations indicate that a system of the present invention could be built with jack units weighing in the range of 50 lbs. (23 kg), including the attached skates, and would have the ability to lift and transport a 10-ton (9 tonne) object.

The jack units each have a jack housing and an extendable element that can be forcibly extended from the jack housing, and which can retract into the jack housing; in use, the extendable element extends and retracts along a vertical lift axis. The extension and retraction can be provided by hydraulic, pneumatic, or mechanical means, depending on the particular applications for which the jack unit is intended. A tongue is affixed with respect to the jack housing so as to extend along a horizontal tongue axis, and in many embodiments is provided on a jack extension that can be affixed to the jack housing at one of multiple vertical positions. The tongue is provided with tongue bearing surfaces that are parallel to the tongue axis. The tongue bearing surfaces are configured to slidably engage a coupling slot that is affixed with respect to the object to be moved; the coupling slot can be formed integrally with the object or can be provided on a coupling element or frame to which the object is secured. The coupling slot has coupling slot bearing surfaces that slidably engage the tongue bearing surfaces in such a manner as to limit motion between the tongue and the coupling slot to translational motion along the tongue axis. A tongue latching structure is provided for securing the tongue in the coupling slot, and the coupling slot has a coupling slot latching structure configured to be lockably engaged by the tongue latching structure; when the latching structures are engaged, their engagement acts to block translation between the tongue and the coupling slot. The tongue may be provided with a selectively extendable pin to serve as the latching structure, in which case the coupling slot is provided with one or more corresponding latch holes into which the pin can be extended.

The extendable element is coupled to one of the skates such that extension and retraction of the extendable element serves to raise and lower the tongue (which is affixed to the jack housing) relative to the skate when the skate rests on an underlying surface. Thus, when the tongue is engaged in the coupling slot, extension of the extendable element acts to raise the object off the underlying surface via the engagement of the tongue with the coupling slot which is secured to the object. When all the jack units of the system have been so extended, the object is lifted off the surface and is supported on the skates, and may then be rolled to a new location. During such rolling operation, the engagement of the tongue with the coupling slot maintains the skate in position relative to the object being moved. Once it has reached the desired location, each of the jack units is operated to retract the extendable element into the jack housing, which acts to lower the tongues relative to the skates, thereby lowering the coupling slots until the object secured thereto rests on the underlying surface in the new location.

When the skates employed do not have caster wheels, the attachment of the skate to the extendable element is such as to allow the skate to rotate about the vertical lift axis to allow the system to be steered when moved. Such rotation could be provided by allowing the extendable element to rotate with respect to the jack housing, or by rotatably mounting the skate to the extendable element. In many situations, it is preferable for the skate to not only be rotatably attached to the extendable element so as to rotate about the vertical lift axis, but to be pivotably mounted so as to also provide limited motion about horizontal axes, to accommodate travel over uneven surfaces and to allow the skate to travel over small obstructions. Connecting the skate to the extendable element via a ball joint or similar flexible joint is one way to allow such pivoting motion. Such flexible movement of the skates helps to balance the load on the jack units to preserve the load capacity of the system by avoiding overloading due to travel over uneven surfaces.

While the skates that are leading in the direction of travel of the object need to be steered, it is typically easier to maneuver the object if the trailing skates are prevented from rotating about the lift axes of the jack units to which they are attached. This could be accomplished by employing dedicated leading and trailing jack units; however, to simplify the system and better accommodate for changes in direction, it is preferred for each of the jack units to have a selectively engagable motion-limiting structure that provides the operator with the option to allow or to block rotation of the skate attached to that particular jack unit. When such a motion limiting structure allows blocking the rotation of the skate in at least two positions, it facilitates changes in the direction of movement of the object. Additionally, the structure can be provided with means for adjusting the alignment of the skate to correct misalignment of the skate and/or structure to which the jack units are attached, eliminating toe-in/out and enhancing tracking of the wheeled load.

To allow the object to be lifted by a crane or similar hoisting device, the jack units can each be provided with a lift eye configured to allow connecting a strap or chain to the jack unit by a shackle or similar device known in the art. When the tongues of the jacks are latched into the coupling slots secured to the object to be moved, connecting the lift eyes to a crane allows the crane to raise the object from the underlying surface and lower it to a new surface, while the skates remain attached to the object. This avoids any need for personnel to work in close proximity to the object while it is suspended, since the skates are maintained in position and thus need not be manually placed under the object as it is lowered. Additionally, since the jack units only need access to the coupling slots, the remainder of the object to be moved can remain enclosed in a crate or similar protective covering during the moving procedure. Furthermore, when the object to be moved is enclosed in a crate, the system of the present invention does not engage the crate, and thus avoids damage to the crate from stresses caused during transport.

While the coupling slots could be formed as a part of the object to be moved, the system of the present invention can include coupling elements that can be attached directly to an object to be moved or can be employed to form a frame to which an object is secured. Each coupling element is preferably provided with two coupling slots that extend orthogonally, allowing the tongue of the jack unit to be mounted in either of two positions. This allows the jack unit and attached skate to be mounted to the front and back of the object, thereby reducing the overall width of the system to facilitate passage through narrow spaces, or to be mounted alongside the object, thereby providing greater stability. In some situations, an obstruction can be bypassed by lowering the object to rest on the underlying surface and repositioning one or more of the jacks from a position on one side of the obstacle to position on the other side.

When a free-standing frame is desired, the coupling elements should be formed with frame member receptors for accepting elongated frame members, which can be cut to length from tube stock. The coupling elements can form the corners of a frame, and frequently allow the frame to be formed in place around an object to be moved.

BRIEF DESCRIPTION OF DRAWINGS

FIG. 2 shows one of the jack units positioned to be moved into engagement with one of the coupling elements, with a tongue positioned to match the height of a slot on the coupling element.

FIG. 3 illustrates the system when the jack unit has been advanced to insert the tongue into the coupling slot, thereby lockably engaging the jack unit with the coupling element, and thus to the object to be moved.

FIG. 4 illustrates the system when an extendable element has been extended from the jack housing to raise the tongue relative to a skate attached to the extendable element, which lifts the coupling element off the underlying surface so that the object is supported on the skate. Once supported on the skates, the object can be rolled to a desired location.

FIG. 10 also shows how lift eyes on the jack bodies allow the system and the object to which it is attached to be lifted by a crane while the jack units remain attached, eliminating any requirement to position skates under the load when it is to be set down in a new location for increased safety.

FIG. 11 shows the elements exploded, while

FIG. 12 shows them when assembled. The knee attaches to a lug plate that can be positioned on the jack housing so as to maintain the skate in one of three orthogonal directions.

FIG. 24 shows the coupling element partly unassembled, while

FIG. 25 shows the coupling element and two horizontal frame members assembled to form a corner of a frame. A vertical frame member having an adjustable-height foot can also be mounted to the coupling element.

FIG. 26 shows a frame formed by eight coupling elements and associated frame members.

FIGS. 29 and 30 illustrate a coupling element that allows a jack unit to be attached at one of three positions, either alongside the object to be moved, fore-and-aft of the object, or at a 45 position. The coupling element is provided with three coupling slots, any one of which can be latchably engaged by the tongue of a jack unit.

FIG. 30 shows a jack unit attached at a 45 angle. The jack unit shown is a hydraulic jack that employs a hydraulic accumulator to provide a damped response to impacts on the skate, while providing a greater load capacity than is provided by pneumatic jack units.

FIG. 31 illustrates a lifting and transporting system that is designed to move relatively small objects within confined spaces. The system has four pneumatic jack units attached to ends of a frame, as well as a pair of supplementary wheel attachments that are centrally-mounted to the frame. The jacks can be lowered to allow the system to be steered using the supplementary wheels.

FIG. 32 illustrates one of the supplementary wheel attachments, which a sleeve sized to slide over a frame member prior to assembly of the frame.

FIG. 33 illustrates another attachment that can be mounted onto a frame to increase its functionality This attachment is a forklift pocket attachment that mounts to a frame member via a sleeve and is used in pairs to allow the frame to be safely lifted and transported on the tines of a forklift.

FIG. 34 illustrates another possible frame attachment, an anchor point attachment that provides a location on the frame to which a strap can be attached to facilitate securing an object to be moved.

MODES FOR CARRYING OUT THE INVENTION

Figure 1:
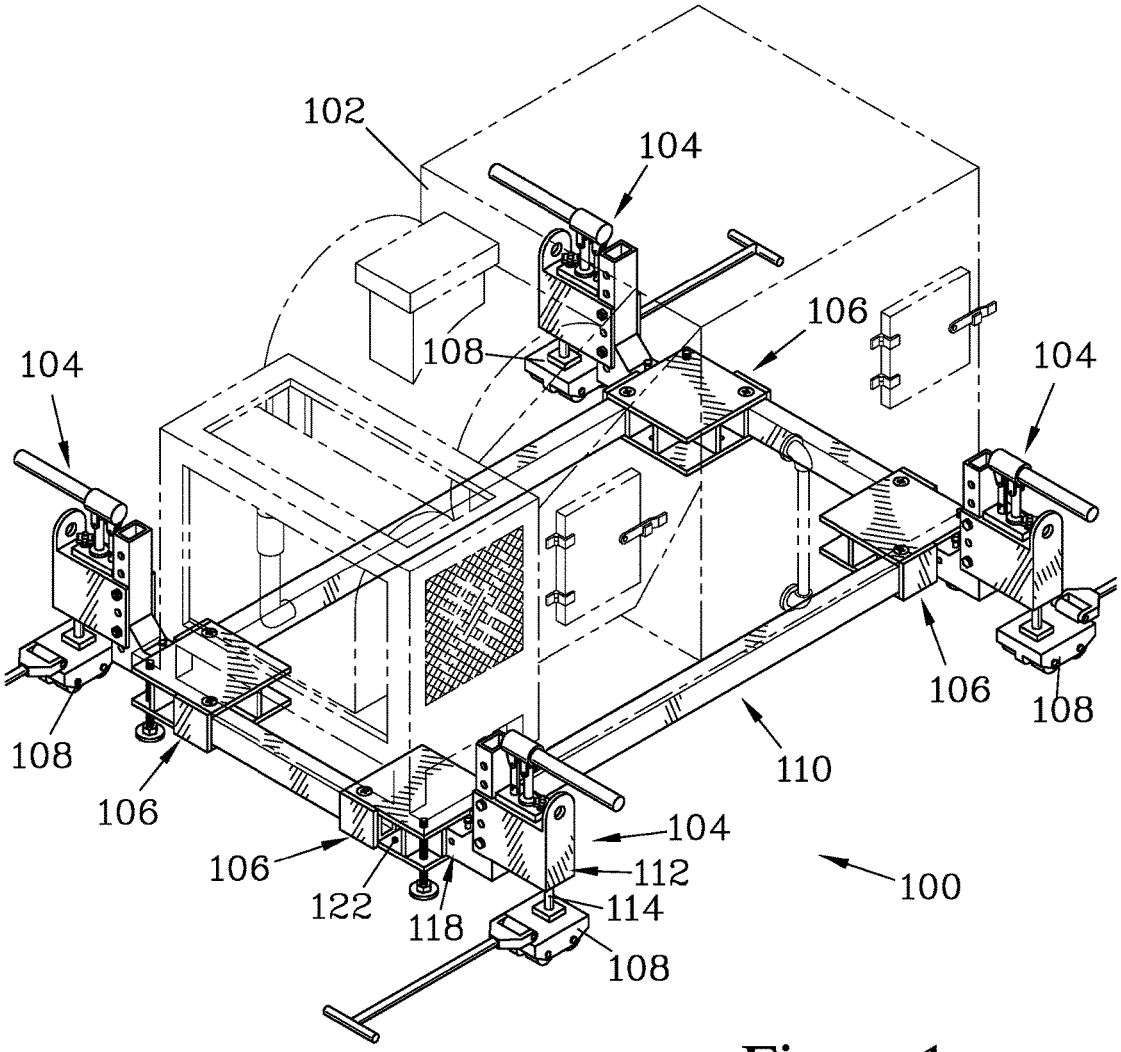
FIG. 1 is an isometric view of one embodiment of the lifting and transporting system of the present invention, shown engaged with an object to be transported (shown in phantom). The system includes four jack units, each positioned near one corner of the object and engaged with a coupling element which forms one corner of a frame on which the object is supported. As illustrated, the jack units are attached to the sides of the frame so as to extend beyond the side of the load carried by the frame for stability.

FIG. 1 is an isometric view of one embodiment of a lifting and transporting system 100 of the present invention, which is shown engaged with a load 102 (shown in phantom in FIG. 1). The system 100 includes a set of jack units 104 that lockably engage coupling elements 106 that, in turn, are secured to the load 102. Each of the jack units 104 has a skate 108 attached thereto, providing a load-bearing support for the jack unit 104 which can be rolled over an underlying surface. In the system 100, four jack units 104 are employed, and the coupling elements 106 form the corners of a frame 110 to which the load 102 is secured by attachment means (not shown), which could include straps, fasteners, welding, or other attachment means known in the art.

Figure 2:
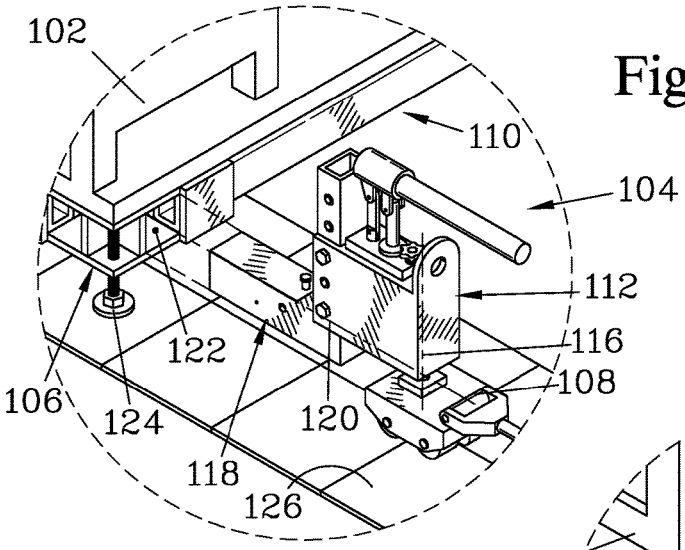
FIGS. 2-4 are detail views showing one corner of the system shown in FIG. 1, illustrating the operation of the system.
Figure 3:
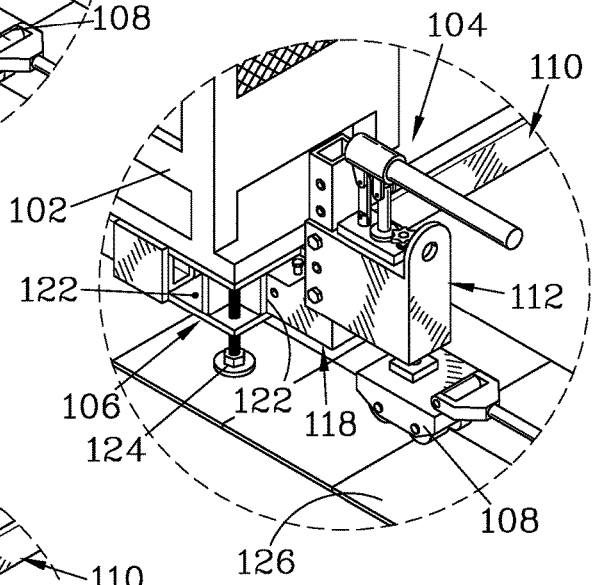
Figure 4:
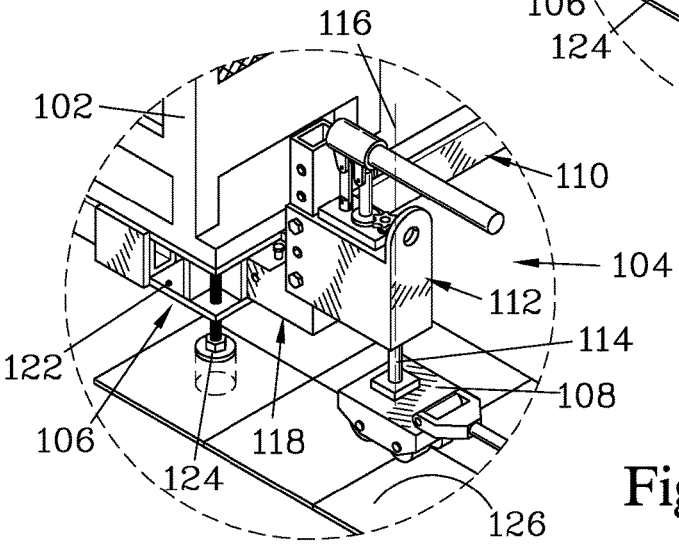

FIGS. 2-4 illustrate the interaction of one of the jack units 104 with one of the coupling elements 106. The jack unit 104 has a jack housing 112 and an extendable element 114 (shown in FIG. 4) that can be forcibly extended from the jack housing 112 along a vertical lift axis 116. The skate 108 is attached to the extendable element 114, and thus extension and retraction of the extendable element 114 acts to change the separation distance between the jack housing 112 and the skate 108.

The jack unit 104 has a tongue 118 that is affixed to the jack housing 112 so as to extend along a horizontal tongue axis 120, and which is designed to slidably and lockably engage a coupling slot 122 provided in the coupling element 106. This engagement is discussed below with regard to FIG. 6. While the system 100 employs the frame 110, the jack units 104 could also be employed to lift and transport a load that has coupling slots provided as an integral part of the load. Each coupling element 106 of the system 100 has a threadably-adjustable leveling foot 124 that engages an underlying surface 126 to locate the coupling slot 122 at a set height thereabove.

As shown in FIG. 2, to engage the jack unit 104 with the coupling element 106, the jack unit 104 is configured with the tongue 118 at a height where it can be slidably inserted into the coupling slot 122. Once inserted, as shown in FIG. 3, the coupling element 106 can be supported on the tongue 118. When the jack unit 104 is activated to forcibly extend the extendable element 114, as shown in FIG. 4, the jack housing 112 and the tongue 118 affixed thereto are raised relative to the skate 108, and the supportable engagement of the tongue 118 with the coupling slot 122 lifts the coupling element 106 off the surface 126. Once raised, the coupling element 106 is supported relative to the skate 108, as are as the frame 110 (of which the coupling element 106 is a part) and the load 102 secured thereto, allowing the load 102 to be rolled over the surface 126 to a new location.

Figure 5:
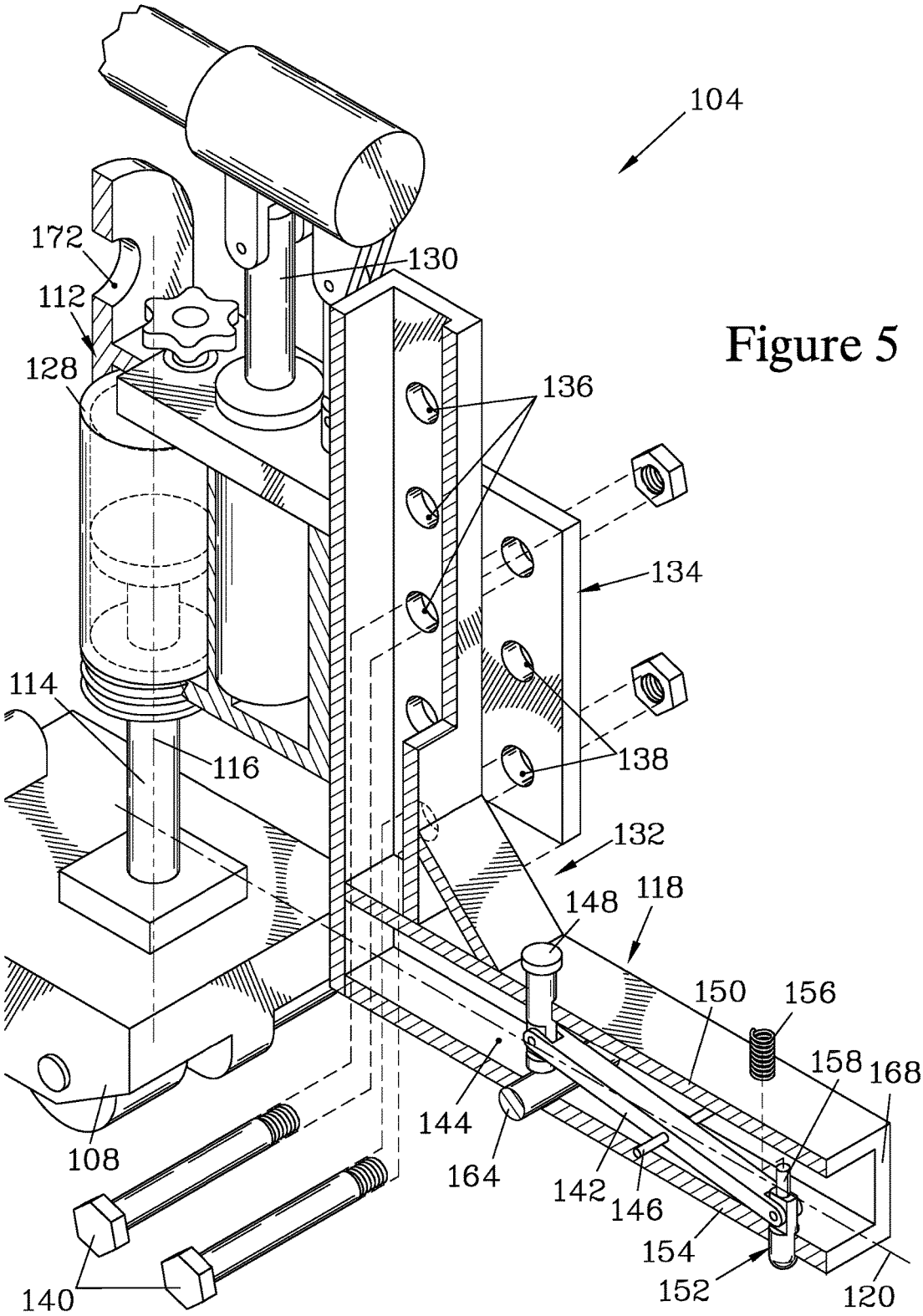
FIG. 5 is a partially sectioned view of one the jack units, showing some of the elements of the jack unit.

FIG. 5 is a sectioned view of one of the jack units 104. The jack unit 104 shown employs a hydraulic piston as the extendable element 114. Contained in the jack housing 112 is a hydraulic cylinder 128 driven by a manually-operated pump 130. The pump 130 can be operated to increase the pressure in the cylinder 128, and this increased pressure drives the extendable element 114 downward. If the pressure in the cylinder 128 is released, the extendable element can retract into the jack housing 112.

The tongue 118 could be affixed directly to the jack housing 112, but greater flexibility in adjusting the height of the tongue 118 is provided by forming the tongue 118 as part of a jack extension 132 that can be affixed to the jack housing 112 at varying heights. In the jack unit 104, such vertical adjustment is provided by a channel 134 on the jack housing 112 that slidably engages the jack extension 132, in combination with a series of spaced extension passages 136 and matching channel passages 138 that can be aligned to set the desired height before being secured together by bolts 140 passing through the aligned passages (136, 138). The adjustment to the height of the tongue 118 allows the tongue 118 to be positioned to engage the coupling slot 122 (shown in FIGS. 1-4) when positioned at various heights while requiring little, if any, extension of the extendable element 114 to vary the height. The jack units 104 could be employed to move a load that is provided with integral coupling slots, in which case variation in the height of the tongue 118 allows greater freedom in locating such coupling slots on the load. Preliminary analysis indicates that the jack extension 132 is a critical component when determining load capacity, and for typical loading applications it is felt that the jack extension 132 can be fabricated from high grade steel square tube stock, either 2-inch (50.8 mm) or 2½-inch (63.5 mm) square, with a ¼-inch (6.35 mm) wall thickness.

Figure 6:
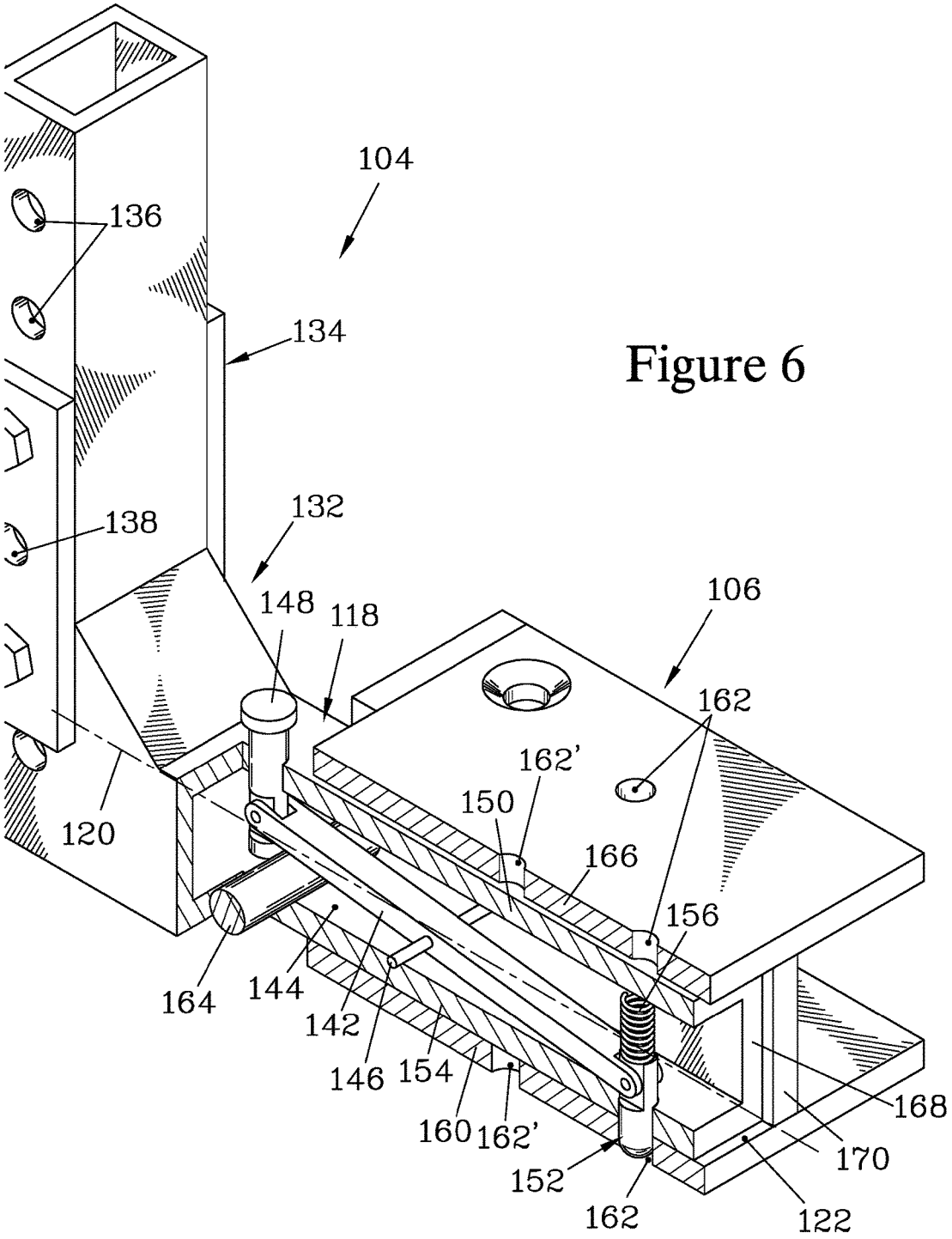
FIG. 6 is a sectioned view illustrating the structure for latching the tongue of the jack unit with the coupling element.

FIG. 6 illustrates the engagement of the tongue 118 with the coupling element 106, showing one scheme for lockably engaging the tongue 118 in the coupling slot 122. In this embodiment, the tongue 118 has a beam 142 which is pivotably mounted in a cavity 144 in the tongue 118 by a pivot pin 146. Attached to the beam 142 in the region closest to the jack housing 112 is a release pin 148 which is pivotably attached to the beam 142 and passes through a tongue top wall 150 of the tongue 118. At the other end region of the beam 142, a latch pin 152 is pivotably attached to the beam 142, the latch pin 152 passing through a tongue bottom wall 154 of the tongue 118. A compression spring 156 is mounted on an latch pin extension 158 so as to bias the latch pin 152 to protrude beyond the tongue bottom wall 154.

The coupling element 106 has two coupling slots 122 (only one of which is visible in FIG. 6) that extend orthogonally to each other, each being configured to slidably engage the tongue 118; in combination, the coupling slots 122 allow the tongue 118 to be inserted in either of two orientations, so as to reside either to the side of the load 102 (as shown in FIG. 1) or in front or behind the load 102. Referring again to FIG. 6, each coupling slot 122 has a slot bottom wall 160 that is provided with a latch hole 162 positioned to be engaged by the latch pin 152 to lock the tongue 118 in the coupling slot 122. To release the tongue 118, the operator pushes the release pin 148, which pivots the beam 142 so as to retract the latch pin 152 (against the bias of compression spring 156) from the latch hole 162, after which the tongue 118 can be slid along the tongue axis 120 out of the coupling slot 122. To prevent accidental release, a cross-pin 164 can be provided through the tongue 118, positioned to block pivoting of the beam 142. In some situations, it is desirable to attach the jack unit 104 to the coupling element 106 with the tongue 118 only partly inserted; for such situations, one or more additional latch holes 162' can be provided. However, the load rating of the system 100 is reduced when the tongue 118 is lockably engaged with the coupling slot 122 at such an intermediate position. Markings could be provided on the tongue 118 to indicate the load rating at each position of insertion. The latch hole 162' illustrated is centrally positioned (as better shown in FIG. 8) so as to accept the latch pin 152 when the tongue 118 is inserted into either of the orthogonal coupling slots 122. Additional flexibility of the system 100 could be provided by including one or more latch holes in a slot top wall 166 of the coupling slot 122, allowing the tongue 118 to be latchably engaged with the coupling slot in an inverted position, such as the position illustrated in FIG. 8 and discussed below.

In the system 100, the tongue 118 is formed as a rectangular tube with its top and bottom walls (150, 154) extending parallel to the tongue axis 120, as well as having tongue sidewalls 168 (only one of which is shown in the sectioned view of FIGS. 5 and 6) that also extend parallel to the tongue axis 120. The coupling element 106 is formed with the slot bottom and top walls (160, 166) as well as with slot sidewalls 170 (only one of which is shown in the sectioned view of FIG. 6) that extend parallel to a horizontal axis (which can be considered coincident with tongue axis 120 shown) and which are positioned so as to be slidably engagable by the corresponding walls (150, 154, 168) of the tongue 118. This engagement limits motion between the tongue 118 and the coupling slot 122 to translational motion along the tongue axis 120, allowing the tongue 118 to firmly support the coupling element 106 when the tongue 118 is raised as shown in FIG. 4. Thus, when the latch pin 152 lockably engages the coupling slot 122 to block such axial motion, this engagement serves to rigidly connect the jack unit 104 with respect to the load 102 throughout the moving procedure.

Figure 7:
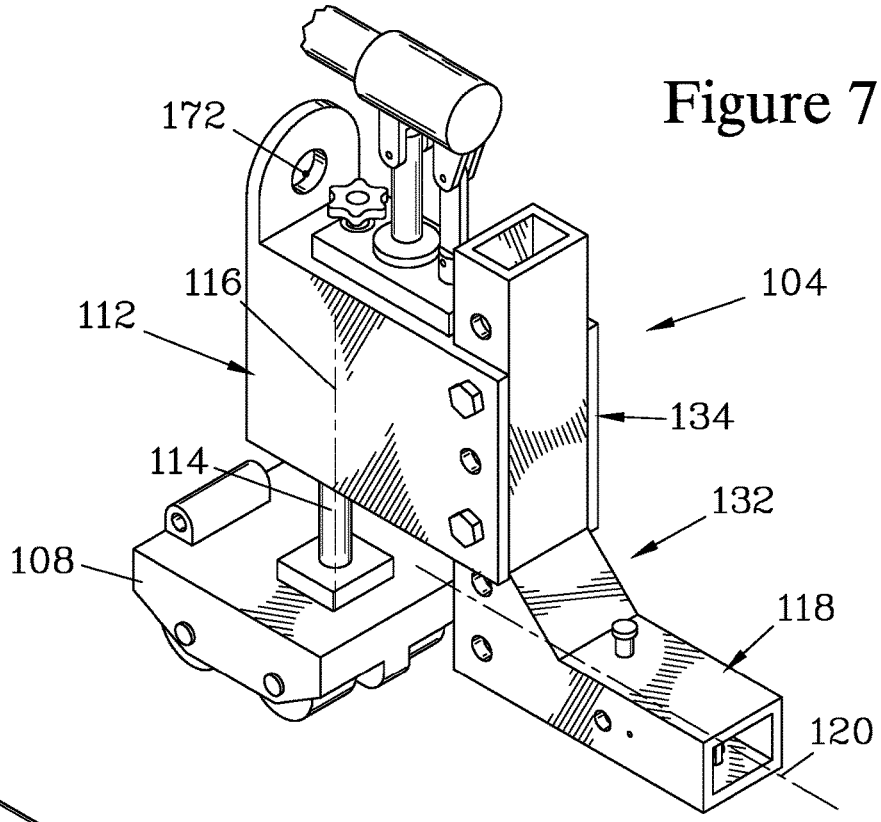
FIG. 7 is an isometric view illustrating the jack unit and skate where an extension on which the tongue is provided has been affixed to a jack housing in a lower position to couple to an object having a coupling slot placed close to the underlying surface.
Figure 8:
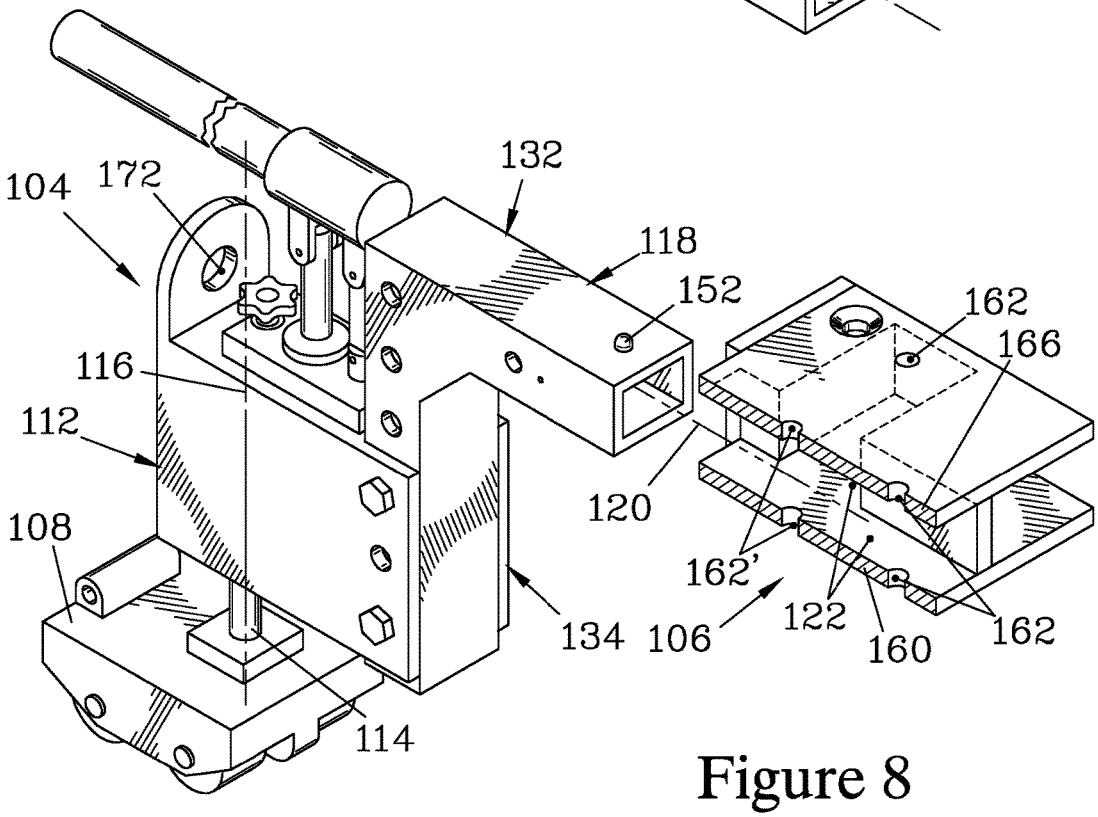
FIG. 8 illustrates the jack unit and skate when the jack extension has been attached to the jack housing in an inverted position to position the tongue at a greater height, while maintaining a small extension of the extendable element. The coupling element is configure to latch with the tongue in such an inverted position.

FIGS. 7 and 8 illustrate how the jack extension 132 can be mounted to the jack housing 112 to place the tongue 118 at various elevations to allow it to lockably engage a coupling slot such as the coupling slot 122 of the coupling element 106 (shown in FIG. 8) when the coupling slot 122 is located at various heights. As shown in FIG. 7, the jack extension 132 has been attached to the jack housing 112 at a position lower than that shown in FIGS. 1-4 for the jack unit 104, allowing the tongue 118 to be placed nearly at the level of the underlying surface. The ability to adjust the height of the tongue 118 relative to the jack housing 112 also allows the jack unit 104 to be employed with various configurations of skates 108, thereby allowing an operator to readily incorporate existing skates into the system 100 to reduce costs.

As shown in FIG. 8, the extension 132 is attached to the jack housing 112 in an inverted position, placing the tongue 118 at a relatively high elevation. Since the latch pin 152 of the tongue 118 is also inverted in this position, the coupling slot 122 for receiving the tongue 118 at such elevation must be constructed to accept the latch pin 152 in this orientation, having latch holes (162, 162') provided in both the slot bottom wall 160 and the slot top wall 166.

The ability to attach the extension 132 to the jack housing 112 at various elevations allows the placement of the tongue 118 at various elevations while maintaining a very limited extension of the extendable element 114, thereby limiting the possible height to which a supported load can be lifted. This height limitation significantly reduces the risk to the operator employing the system of the present invention to lift and transport loads in situations where there is no need to raise the load for placement on an elevated platform. Limiting the extension of the extendable element 114 also serves to reduce bending moments on the extendable element 114. Also, the ability to adjust and reconfigure the jack unit 104 provides it with excellent height range while keeping the parts small and therefore relatively light in weight.

To facilitate lifting the system 100 by a crane or similar hoisting device, each jack unit 104 is provided with a lift eye 172 mounted on the jack housing 112. The use of a crane to lift the system of the present invention is further discussed below.

Figure 9:
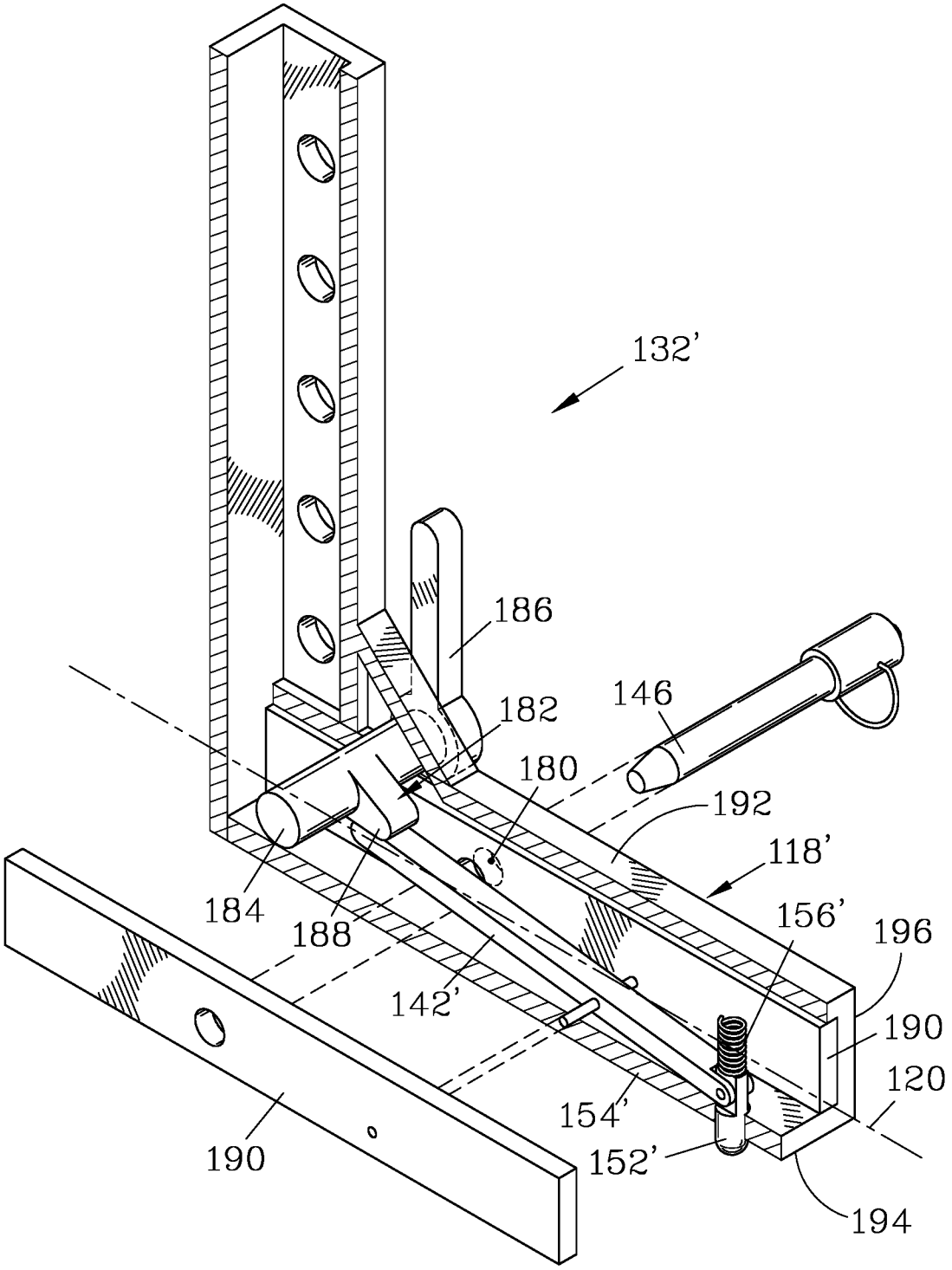
FIG. 9 is a sectioned illustration of a jack extension similar to that shown in FIGS. 1-8, but employing an alternative latching structure that provides greater ease and operator safety when releasing the latch to withdraw the tongue from the coupling slot.

FIG. 9 illustrates a jack extension 132' that employs one alternative means for retracting a latch pin 152' into a tongue 118' to allow the tongue 118' to be disengaged from a coupling slot (not shown). The mechanism for moving the latch pin 152' is similar to that employed in the tongue 118 of the jack extension 132 shown in FIGS. 5 and 6 and discussed above. Again, the latch pin 152' is pivotably attached to one end of a pivoting beam 142', and is biased by a compression spring 156' to an extended position where the latch pin 152' protrudes from a tongue bottom wall 154'. Depressing the other end of the beam 142' acts to raise the latch pin 152' against the bias of the compression spring 156' to a retracted position (not shown) where it does not protrude beyond the tongue bottom wall 154', allowing the tongue 118' to slide with respect to the coupling slot. A cross-pin 146 can be inserted through pin passages 180 (only one of which is visible in FIG. 17) through the tongue 118' to block pivoting of the beam 142' when it is desired to secure the latch pin 152' in its extended position.

In the jack extension 132', the beam 142' is depressed by a cam 182 affixed to a cam shaft 184 that is rotatably mounted in the jack extension 132'. The cam shaft 184 can be rotated by a latch handle 186 that is located on the exterior of the jack extension 132'. When the latch handle 186 is rotated by the operator, a lug 188 on the cam 182 depresses the beam 142', raising the latch pin 152'. The latch handle 186 provides the operator with a significant mechanical advantage compared to the release pin 148 employed in the jack extension 132, aiding the operator in overcoming frictional forces on the latch pin 152' due to loading forces between the tongue 118' and the coupling slot. Additionally, when operating the latch handle 186, the hand of the operator is positioned alongside the jack extension 132' at a location spaced away from the coupling slot to avoid a risk of being pinched.

The jack extension 132' also employs a pair of reinforcing plates 190 that add strength to the tongue 118', which preliminary analysis indicates to be the limiting component of the system. The reinforcing plates 190 are inserted into the square tube that forms the tongue 118', doubling effective thickness along the sides to increase the resistance to bending. Additionally, mounting the beam 142' between the reinforcing plates 190 prior to inserting them into the tongue 118' simplifies assembly by assuring the correct positioning of the beam 142' in the tongue 118'.

The jack extension 132' illustrated is formed from square tubular stock, and thus the tongue 118' is provided with a tongue upper bearing surface 192, a tongue lower bearing surface 194, and a pair of tongue side bearing surfaces 196, all of these bearing surfaces (192, 194, 196) extending parallel to the tongue axis 120.

Figure 10:
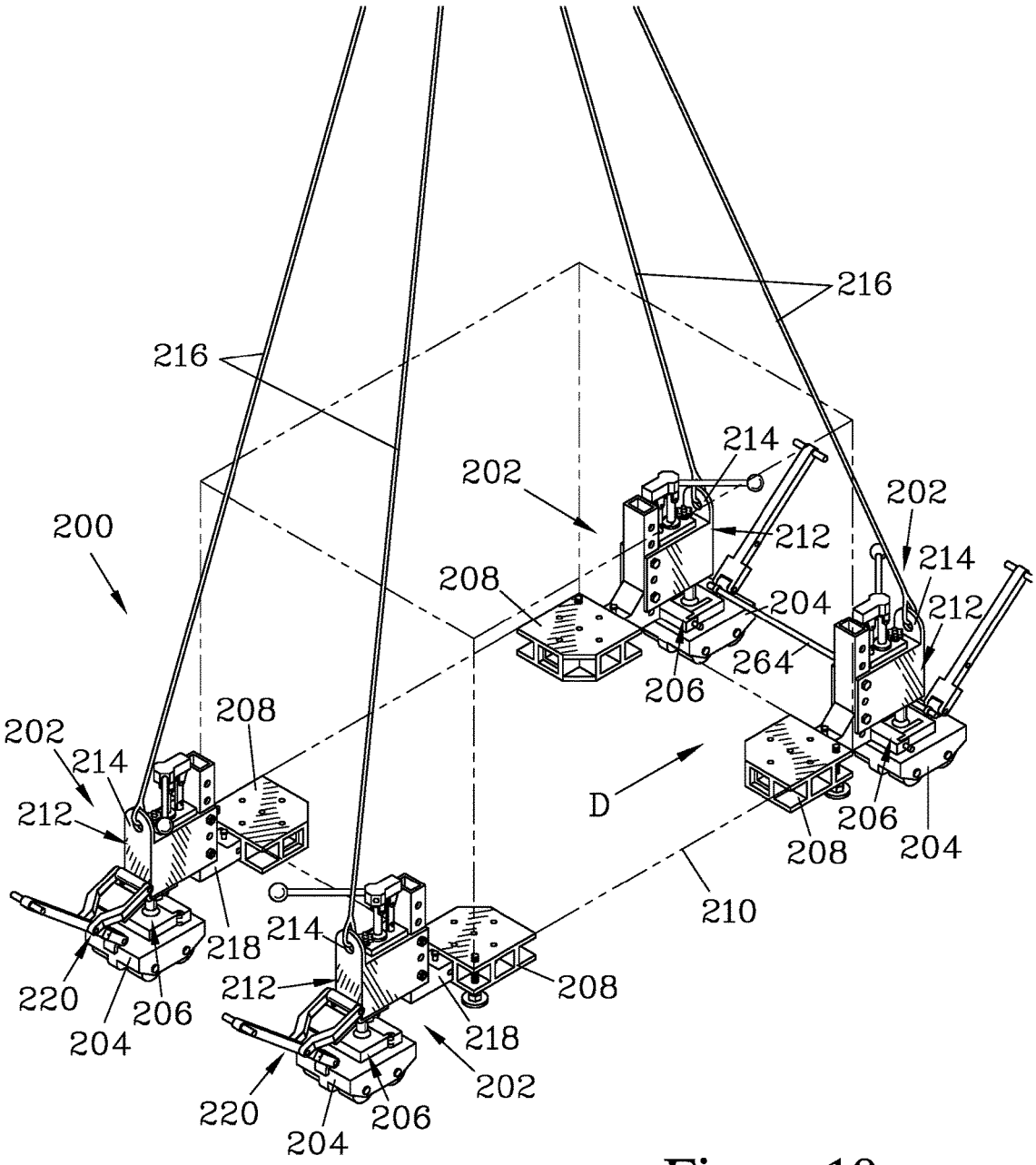
FIG. 10 is an isometric view illustrating a lifting and transporting system in which the skates that are trailing when the object is moved (in a direction away from the viewer) are limited from rotating relative to the jack units to which they are attached, in order to improve tracking of the system when moved. Motion-limiting knees are connected between the trailing jack units and skates to limit rotation, while the leading skates are connected together by a tie bar to coordinate their steering. The jacks are shown attached fore-and-aft of the object being moved to reduce the width of the system.

FIG. 10 is an isometric view illustrating a lifting and transporting system 200 which forms another embodiment of the present invention. The system 200 employs a series of jack units 202 which are attached to skates 204 by ball joints 206, accommodating greater freedom of motion of the skates 204, and which engage coupling elements 208 that are affixed directly to a load 210 (shown in phantom). In this embodiment, the coupling elements 208 are affixed directly to the structure of the load 210 rather than being components of an independent frame, and could be formed as integral parts of the load 210. As shown in FIG. 10, the jack units 202 are engaged with the coupling elements 208 such that the jack units 202 are positioned fore and aft of the load 210, rather than to the side thereof as shown for the system 100 illustrated in FIG. 1. Placing the jack units 202 fore and aft of the load 210 allows the system 200 to more readily traverse a narrow opening, and the system 200 can be configured such that the system 200 does not extend any wider than the load 210 itself. Since all the skates 204 are independently steerable, they can be configured, for example, to roll tangentially and so allow turning the load 210 in its own length.

The jack units 202 each have a jack housing 212 that is provided with a lift eye 214. The lift eyes 214 allow the jack units 202 to be attached to lift straps 216 to enable a crane or other hoist to lift the system 200 and the load 210 attached thereto. When the lift eye 214 is positioned opposite a tongue 218 of the jack unit 202, the jack housing 212 serves as a spreader to help prevent interference of the lift straps 216 with the load 210. Further extension could be provided by designing the coupling elements 208 to latchably engage the tongues 218 in one or more positions where the tongue 218 is not fully inserted; however, as noted above, such extension reduces the load that can be supported by the jack units 202 in such a position. Depending on the shape of the load 210, interference of the straps 216 with the load 210 might also be avoided by positioning the jack units 202 alongside the load 210, rather than on the ends as illustrated in FIG. 10. The ability to rest the load 210 on the coupling elements 208 and reposition the jack units 202 allows the operator to position the jack units 202 alongside for lifting and lowering the load 210, and then reposition the jack units 202 fore and aft of the load 210 (as illustrated) to negotiate a narrow space. It should be noted that the jack units 202 and the skates 204 remain attached to the load 210 as it is lifted and set down at a new location, eliminating any need to position skates or rollers under the load while it is suspended; this eliminates hazard to the operators that would otherwise result from having to work in close proximity to the load 210 while it is suspended.

Figure 11:
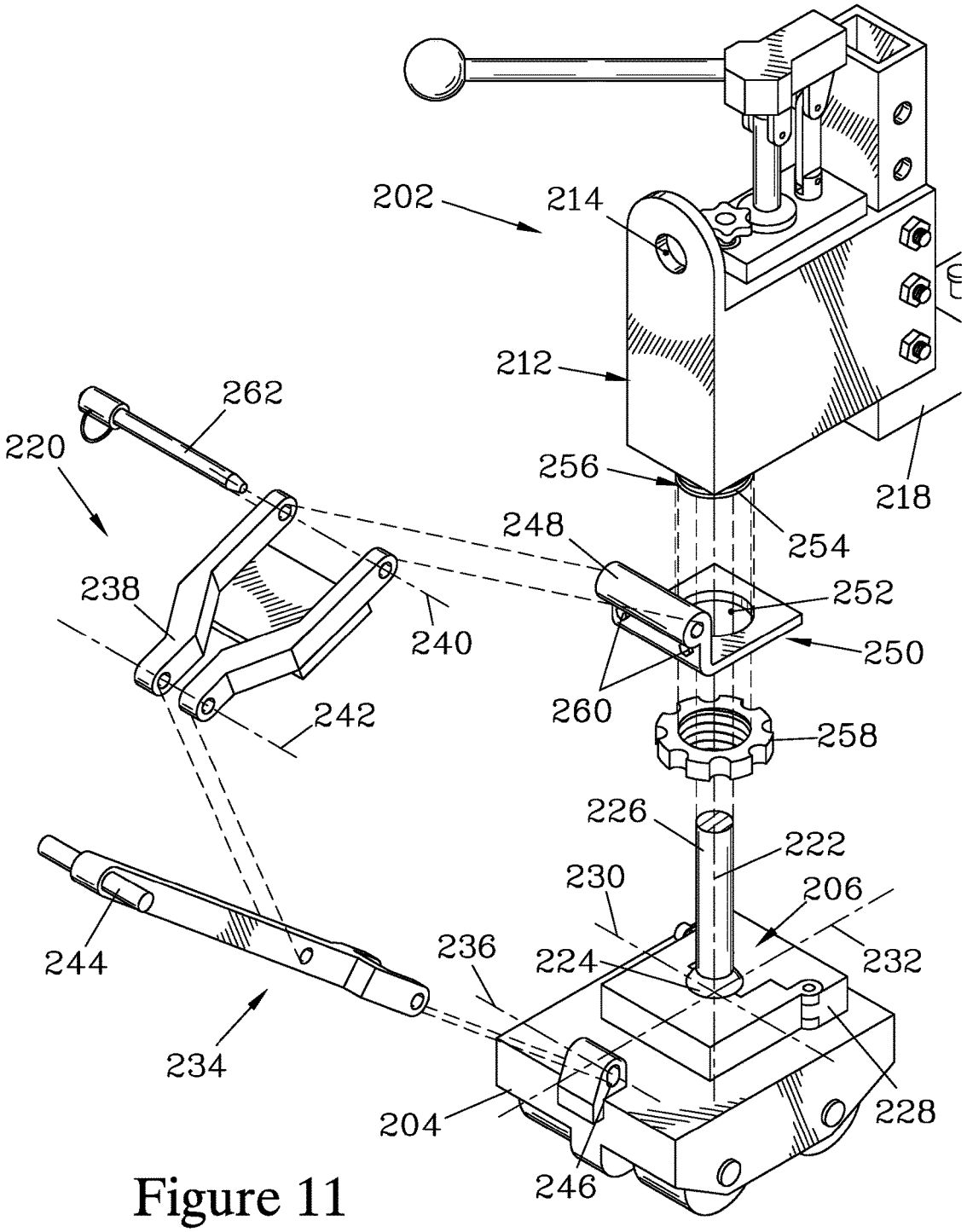
FIGS. 11 and 12 illustrate one of the motion-limiting knees used to limit rotation.

To aid in moving the system 200, the two of the jacks 202 that are trailing as the load 210 is moved in the direction D (away from the viewer) are each provided with a motion-limiting knee 220 that connects between the jack unit 202 and the associated skate 204 to block rotation of the skate 204 about a lift axis 222 (shown in FIGS. 11 and 11). The knee 220 aids the system 200 in tracking straight along a desired path of travel. FIG. 10 shows the elements of the knee 220 exploded, while FIG. 12 shows them when assembled.

While blocking rotation about the lift axis 222 aids in steering, it is still desirable to provide a degree of flexibility to accommodate unevenness in the surface to be traversed. A small degree of unevenness can be accommodated by employing skates that incorporate some flexibility in their structure, such as by employing resilient or pneumatic wheels, and/or by using resilient bushings for the axles on which the wheels are mounted; however, use of resilient materials in the skates typically limits the load capacity of the skate and increases the wear on its components. Such limitations can be overcome by mounting the skates 204 to the jack units 202 via the ball joints 206. Each of the ball joints 206 has a ball 224, which is affixed to an extendable element 226 of the jack unit 202, and a ball receiver 228, which is affixed to the skate 204 and rotatably engages the ball 224. If the skate 204 encounters a surface contour that causes it to tilt relative to the jack housing 212 and tongue 218, such tilting is accommodated by flexibility of the ball joint 206 rather than generating torques on the extendable element 226. The ball receiver 228 must be designed to securely engage the ball 224 in order to connect the skate 204 securely to the extendable element 226 to prevent the skate 204 from becoming detached and presenting a hazard when the jack unit 202 is suspended from a crane via the lift eye 214.

The knee 220 allows a degree of pitching motion (pivoting about a transverse axis 230 that is parallel to the axis of rotation of the wheels of the skate 204) of the skate 204 relative to the jack housing 212 to aid the skate 204 in traversing small obstructions in the path of travel. The connection of the knee 220 to the skate 204 can be designed to also provide limited rolling motion (pivoting about a longitudinal axis 232 that is parallel to the direction of travel of the system 200) of the skate 204 to better accommodate movement over uneven surfaces. For typical applications, it is felt that the flexibility for the skate 204 to pitch about the transverse axis 230 by about ±20 and to roll about the longitudinal axis 232 by about ±5 should be sufficient to accommodate travel over uneven surfaces.

Figure 12:
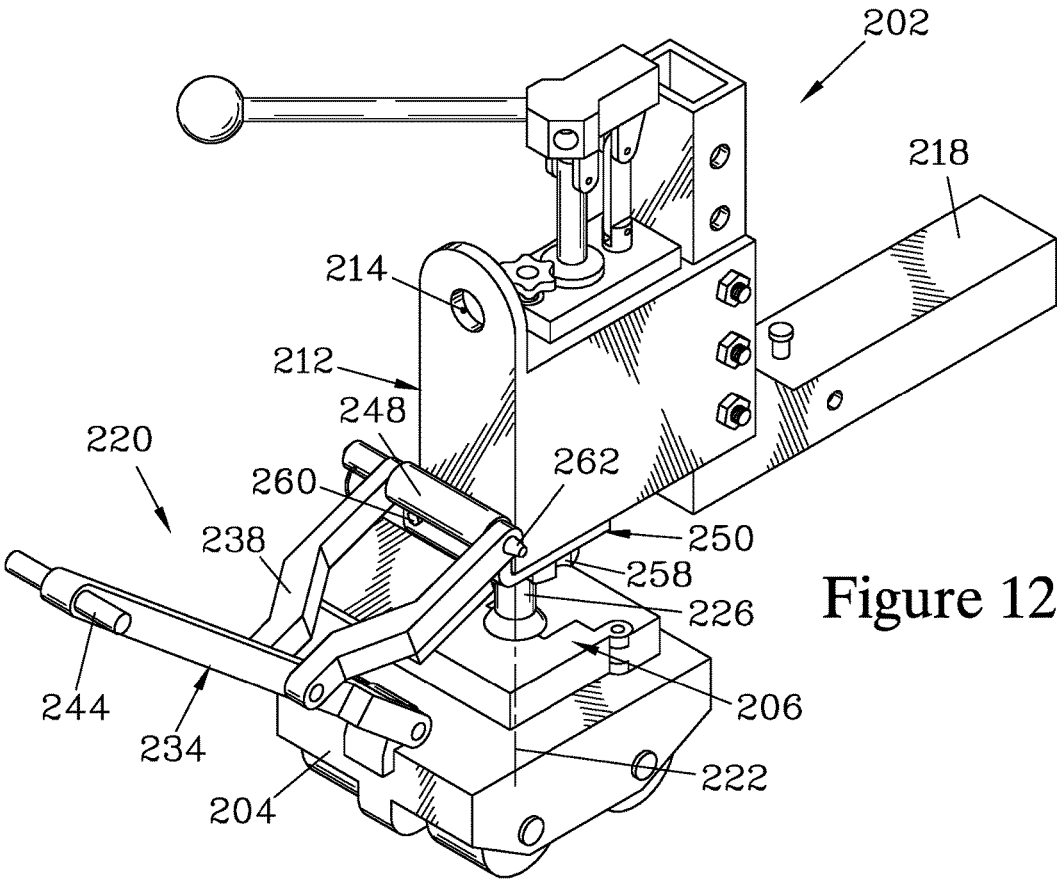

As shown in FIGS. 11 and 12, the knee 220 has a knee lower member 234, which is pivotably attached to the skate 204 about a nominally horizontal lower member pivot axis 236, and a knee upper member 238, which is pivotably attached to the jack housing 212 about a nominally horizontal upper member pivot axis 240; the knee members (234 and 238) in turn are pivotably attached together about a nominally horizontal knee intermediate pivot axis 242. The knee lower member 234 can be extended and provided with a handle 244 to aid the operator in moving the skate 204. The knee lower member 234 attaches to the skate 204 via a vertically-elongated lower pivot passage 246 to provide limited rolling motion about the longitudinal axis 232.

Figure 13:
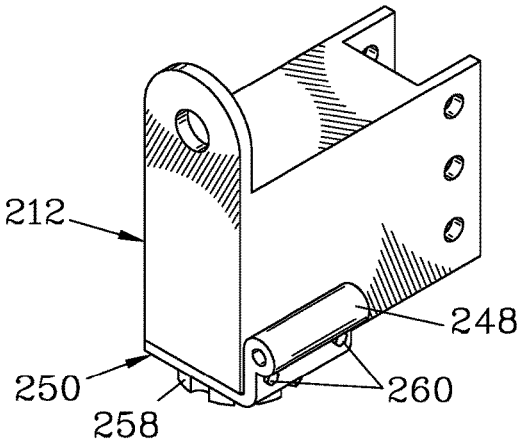
FIG. 13 illustrates the jack housing and lug plate when the orientation has been changed from that shown in FIG. 12.

In the knee 220, the pivotable attachment of the knee upper member 238 to the jack housing 212 is accomplished by attaching the knee upper member 238 to a knee indexing lug 248 provided on a lug plate 250 that in turn is affixed to the jack housing 212. The lug plate 250 can be attached to the jack housing 212 in one of three orientations, allowing the attachment lug 248 and the knee 220 to be positioned on any of the three sides of the jack housing 212 that do not face towards the tongue 218. FIGS. 11 and 12 shown the knee 220 positioned on an end of the jack housing 212 opposite that from which the tongue 218 extends, for use when the jack units 202 are positioned fore and aft of the load 210, as shown in FIG. 10. When the jack units 202 are positioned beside the load 210 (as is shown in FIG. 1 for system 100 and load 102), the attachment lug 248 can be positioned on one side of the jack housing 212, as shown in FIG. 13.

The lug plate 250 has a plate passage 252 (shown in FIG. 11) therethrough that is configured to pass over a threaded end 254 provided on a cylinder 256 from which the extendable element 226 extends. A plate nut 258 threadably attached onto the threaded end 254 to secure the lug plate 250 to the cylinder 256, which in turn is affixed to the jack housing 212.

The lug plate 250 is configured relative to the jack housing 212 such that, when attached thereto, the attachment lug 248 is slightly spaced away from the jack housing 212. A pair of lug alignment bolts 260 can be threadably advanced in the lug plate 250, and are positioned to engage the jack housing 212 when so advanced. The lug alignment bolts 260 can be advanced so as to precisely align the knees 220 that are attached to adjacent skates 204 with respect to each other to correct a toe-in or toe-out situation, and to assure that the adjacent skates 204 are aligned even in the event that the coupling elements 208 to which the jack units 202 are attached are not themselves accurately aligned.

When the knee lower member 234 and the knee upper member 238 are pivotably connected together and to the skate 204 and the attachment lug 248 on the jack housing 212, as shown in FIG. 12, the connection blocks rotation of the skate 204 about the lift axis 222, while allowing the extendable element 226 to freely extend and retract in the cylinder 256.

When it is desired to allow the skate 204 to pivot about the lift axis 222, such as when the system 200 must be rotated or turned, such free motion of the skate 204 can readily be accomplished by removing an upper connector pin 262 that pivotably connects the knee upper member 238 to the attachment lug 248, and pivoting the knee upper member 238 with respect to the knee lower member 234 to a position where it does not interfere with the lug plate 250 or the jack housing 212 as the skate 204 and the knee 220 are pivoted about the lift axis 222. The knee upper member 238 can be designed to fold to a nested position against the knee lower member 234. Alternatively, the knee upper member 238 could be completely removed, as is shown for the leading jack units 202 and skates 204 illustrated in FIG. 10. When such is done, the knee lower member 234, which also serves as a handle for pulling and pushing the skate 204, typically remains attached to the skate 204. If the system 200 is to be moved by a single operator, the leading skates 204 can be connected together by a tie bar 264 to coordinate the rotation of the leading skates 204 about the lift axes 222 of the jack units 202 to which they are attached.

When the knee upper member 238 is disconnected from the attachment lug 248, the plate nut 258 can be unthreaded from the cylinder 256 to allow the lug plate 250 to be dropped down and rotated to position the attachment lug 248 along a different side of the jack housing 212 (as shown in FIG. 13), at which time the lug plate 250 can be raised and resecured to the cylinder 256 in the new position by reattaching and tightening the plate nut 258. This allows the knee 220 to be positioned to aid in tracking when the jack unit 202 is positioned in line with the load 210 or alongside the load 210, as well as allowing the operator to change the direction of travel without requiring space to turn the system 200 and load 210.

When the knee 220 is assembled and connected to both the skate 204 and the jack housing 212, as shown in FIG. 12, the handle 238 formed on the lower knee member 234 is generally fixed in position relative to the jack unit 202 (so long as the extension of the extendable element 214 relative to the jack housing 212 remains constant), and thus the jack unit 202, skate 204, and knee 220 form a rigid unit for greater ease in placing the jack unit 202 into engagement with one of the coupling elements 208.

Figure 14:
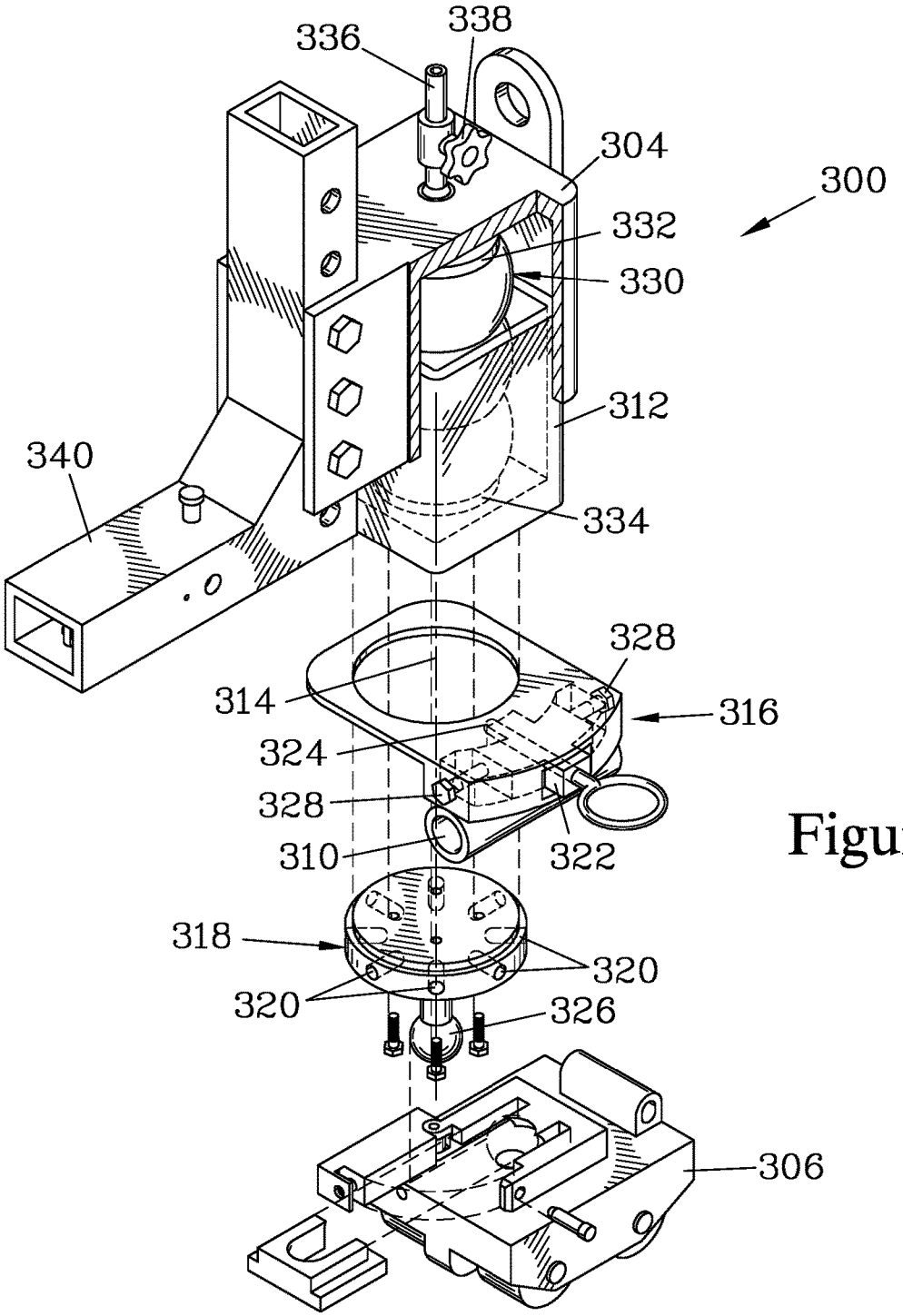
FIGS. 14 and 15 are, respectively, exploded and assembled views of an alternative structure for connecting a knee between a jack unit and a skate to limit rotation of the skate. Instead of a lug plate, this motion-limiting structure employs an indexing bracket and an indexing plate with multiple recesses for accepting a pin mounted in the indexing bracket. This embodiment also differs in employing a pneumatic jack unit that provides a resilient response to impact forces on the skate, reducing transmission of impacts to the object supported by the jack unit.
Figure 15:
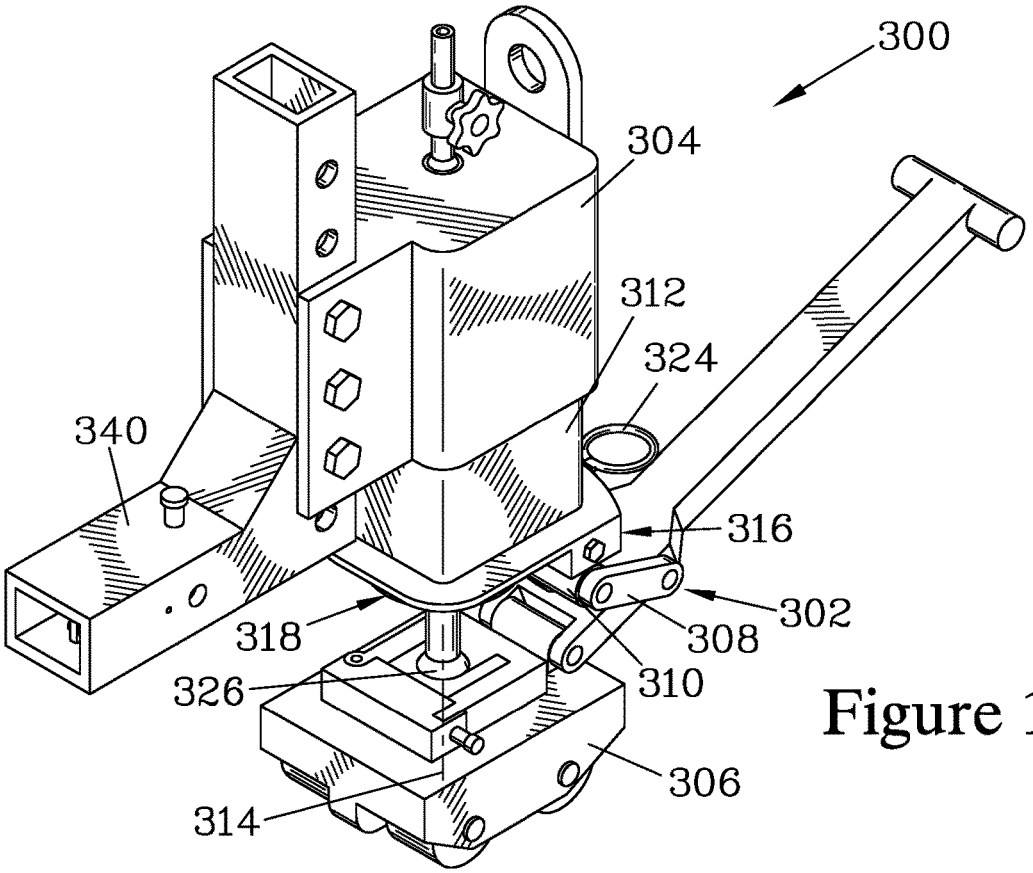

FIGS. 14 and 15 illustrate a jack unit 300 that employs an alternative structure for mounting a knee assembly 302 (shown in FIG. 15) that serves to limit motion between a jack housing 304 and a skate 306. In this embodiment, a knee upper member 308 is pivotably connected to a tube 310 that in turn is adjustably mounted to an extendable element 312 of the jack unit 300, rather than to the jack housing 304. The extendable element 312 of this embodiment is formed as a square tube that telescopes inside the jack housing 304, thus limiting motion between the jack housing 304 and the extendable element 312 to translational motion along a lift axis 314.

The tube 310 is affixed to an indexing bracket 316 that in turn is rotatably mounted to an indexing plate 318; the indexing plate 318 is affixed to the extendable element 312. The indexing bracket 316 rotates with respect to the indexing plate 318 about the lift axis 314. The indexing plate 318 is provided with an array of eight radially-extending index recesses 320, positioned at 45 intervals about the lift axis 314. The indexing bracket 316 has an index block 322 that is translatably engaged by an index pin 324. When the indexing bracket 316 is rotated to a position where the index pin 324 is aligned with one of the index recesses 320, the index pin 324 can be advanced in the index block 322 into the index recess 320, where the engagement of the index pin 324 with the index recess 320 blocks rotation of the indexing bracket 316 with respect to the indexing plate 318. This, in turn, blocks rotation of the tube 310 about the lift axis 314; when the knee assembly 302 is connected between the tube 310 and the skate 306, rotation of the skate 306 about the lift axis 314 is blocked, while pitching and rolling motion is provided by a ball joint 326 that connects the skate 306 to the extendable element 312.

To adjust the alignment of the tube 310 with respect to the jack housing 304, the index block 322 is movably mounted in the indexing bracket 316, and position of the index block 322 in the indexing bracket 316 is adjusted by jack screws 328 mounted in the indexing bracket 316. When the indexing pin 324 is inserted into one of the index recesses 320, adjustment of the jack screws 328 serves to move the position of the index block 322 in the indexing bracket 316, and thus shifts the position of the tube 310 relative to the indexing plate 318.

The jack unit 300 also differs from those discussed above in that it employs a pneumatic expansion element 330 (shown in FIG. 14) to extend or retract the extendable element 312 relative to the jack housing 304; a conventional pneumatic spring can serve as the expansion element 330. The expansion element 330 has a top end 332 attached to the jack housing 304 and a bottom end 334 attached to the extendable element 312. The attachment of the expansion element 330 between the jack housing 304 and the extendable element 312 must be sufficiently secure as to maintain the components of the jack unit 300 together in situations where the jack unit 300 is lifted by the jack housing 304. Additional securing means to prevent separation of the extendable element 312 from the jack housing 304 could be employed for further safety. Air pressure in the expansion element 330 is adjusted by connection to a pneumatic pump or source of pressurized air via a gas connector 336 and a release valve 338; since such sources of pressurized air are frequently available, the need to incorporate a pumping mechanism into the jack unit 300 is avoided, saving expense and weight. Adjusting the pressure in the expansion element 330 causes it to expand and contract, causing the extendable element 312 to extend from or retract into the jack housing 304, thereby raising and lowering a tongue 340 affixed to the jack housing 304 relative to the skate 306. The pneumatic character of the expansion element 330 provides a resilient connection between the skate 306 and the tongue 340, thereby serving to isolate a load attached to the tongue 340 from shocks resulting from travel of the skate 306 over uneven surfaces.

Figure 16:
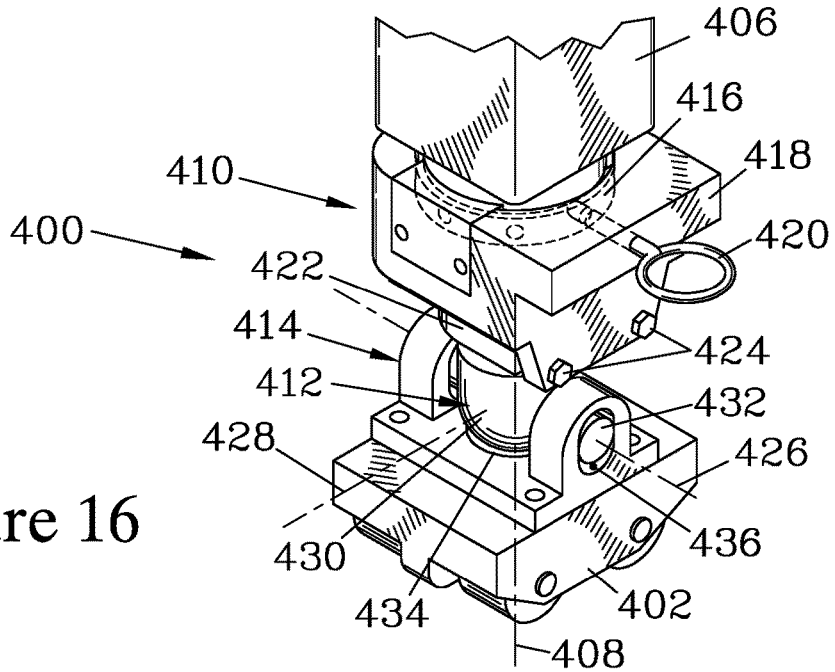
FIGS. 16 and 17 are again, respectively, assembled and exploded views showing an alternative motion-limiting structure. In this embodiment, rotation of the skate is limited by a locking swivel in combination with a ball shaft and a shaft mount on the skate that replace the ball joint employed in earlier embodiments. The locking swivel employs an indexing bracket and indexing plate, while the ball shaft pivotably engages the shaft mount so as to limit the pivotable motion therebetween. The allowed motion provides a range of pitching motion about a transverse axis, a more limited range of rolling motion about a longitudinal axis, and blocks rotation about a vertical lift axis.
Figure 17:
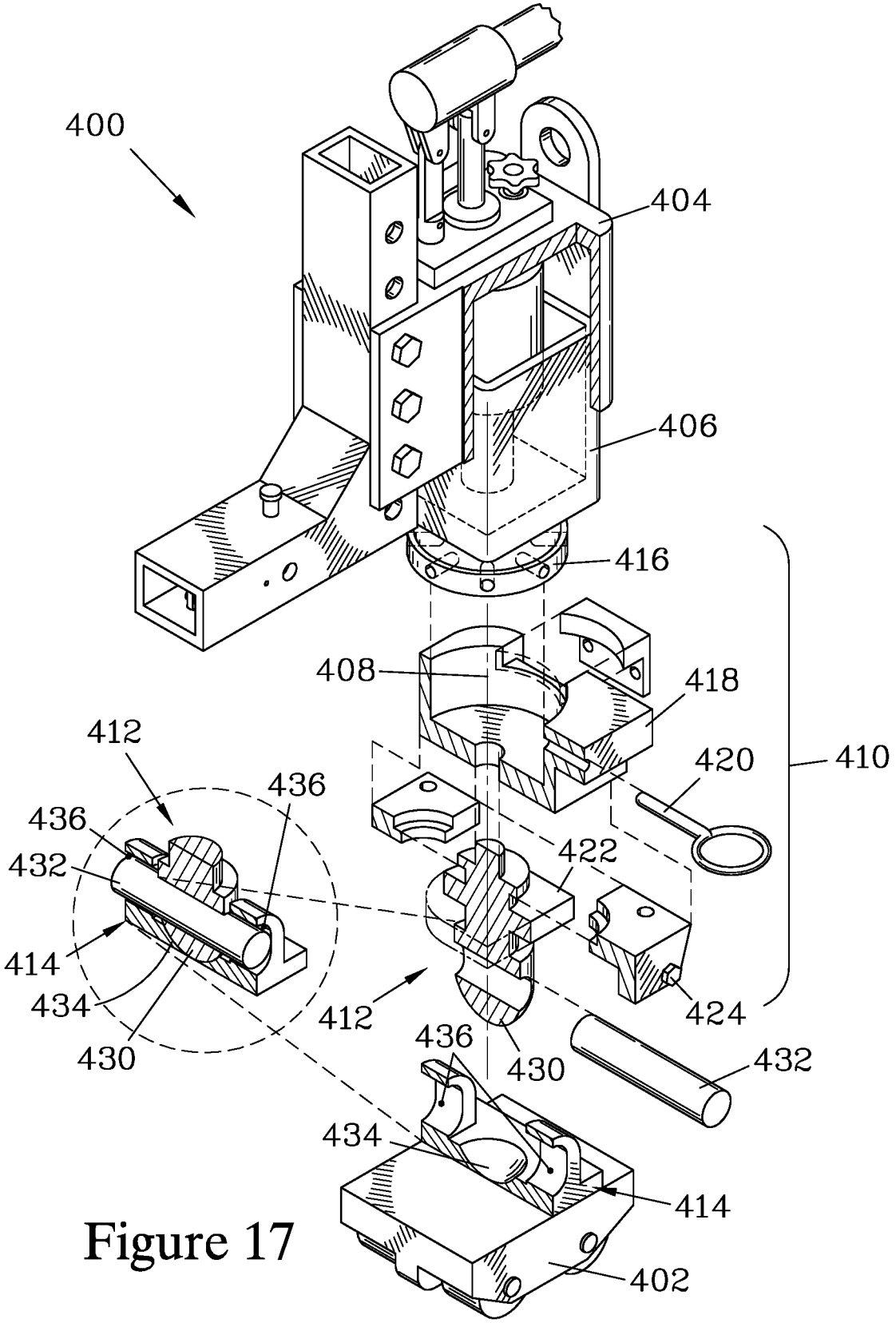

FIGS. 16 and 17 illustrate a jack unit 400 that employs an alternative scheme for limiting motion of a skate 402 with respect to a jack housing 404 (shown in FIG. 17). Again, the jack housing 404 and an extendable element 406 are formed as square telescoping tubes, limiting motion of the extendable element 406 to translation along a lift axis 408. In this embodiment, the skate 402 is attached to the extendable element 406 by a locking swivel 410 (shown assembled in FIG. 16 and exploded in FIG. 17) in combination with a ball shaft 412 that engages a shaft mount 414 to which the skate 402 is affixed.

The locking swivel 410 has an indexing plate 416, which is similar to the indexing plate 318 discussed above, and which is affixed to the extendable element 406. An indexing bracket 418 rotatably engages the indexing plate 416, and is engaged by an index pin 420 that can be advanced into the indexing plate 416 to lock the indexing bracket 418 in a selected one of eight rotational positions about the lift axis 408. In turn, the ball shaft 412 attaches to the indexing bracket 418. While alignment of the indexing bracket 418 relative to the indexing plate 416 could be provided by an index block and jack screws, in this embodiment the alignment is adjusted by pivoting the ball shaft 412 relative to the indexing bracket 418. The ball shaft 412 is pivotably mounted to the indexing bracket 418, and is provided with an adjustment plate 422 that is engaged by a pair of jack screws 424 that limit the pivoting of the ball shaft 412 relative to the indexing bracket 418.

The ball shaft 412 engages the shaft mount 414 in such a manner as to block rotation therebetween about the lift axis 408, while allowing limited pitching motion about a transverse axis 426 and limited rolling motion about a longitudinal axis 428 (these axes being shown in FIG. 16). The ball shaft 412 is provided with a weight-supporting ball-end 430, and a cross-pin 432 that extends horizontally. The shaft mount 414 is provided with a ball-engaging recess 434 that is configured to accept and support the ball-end 430, allowing slidable motion therebetween to provide a similar range of motion to a ball joint such as employed in earlier embodiments. However, this motion is limited by a vertical slots 436 on the shaft mount 414, which engage and constrain the cross pin 432. The vertical slots 436 prevent rotation of the cross pin 432 about the lift axis 408, and allow only a limited range of rolling motion about the longitudinal axis 428, this range being defined by the height of the vertical slots 436. Because the cross-pin 432 is free to rotate with respect to the vertical slots 436 about the transverse axis 426, the range of pitching motion about this axis is limited only by interference of other components, providing a wide range of pitching motion to allow the skate 402 to travel over steps, ledges, and other height differences and obstructions in the surface to be traversed.

Figure 18:
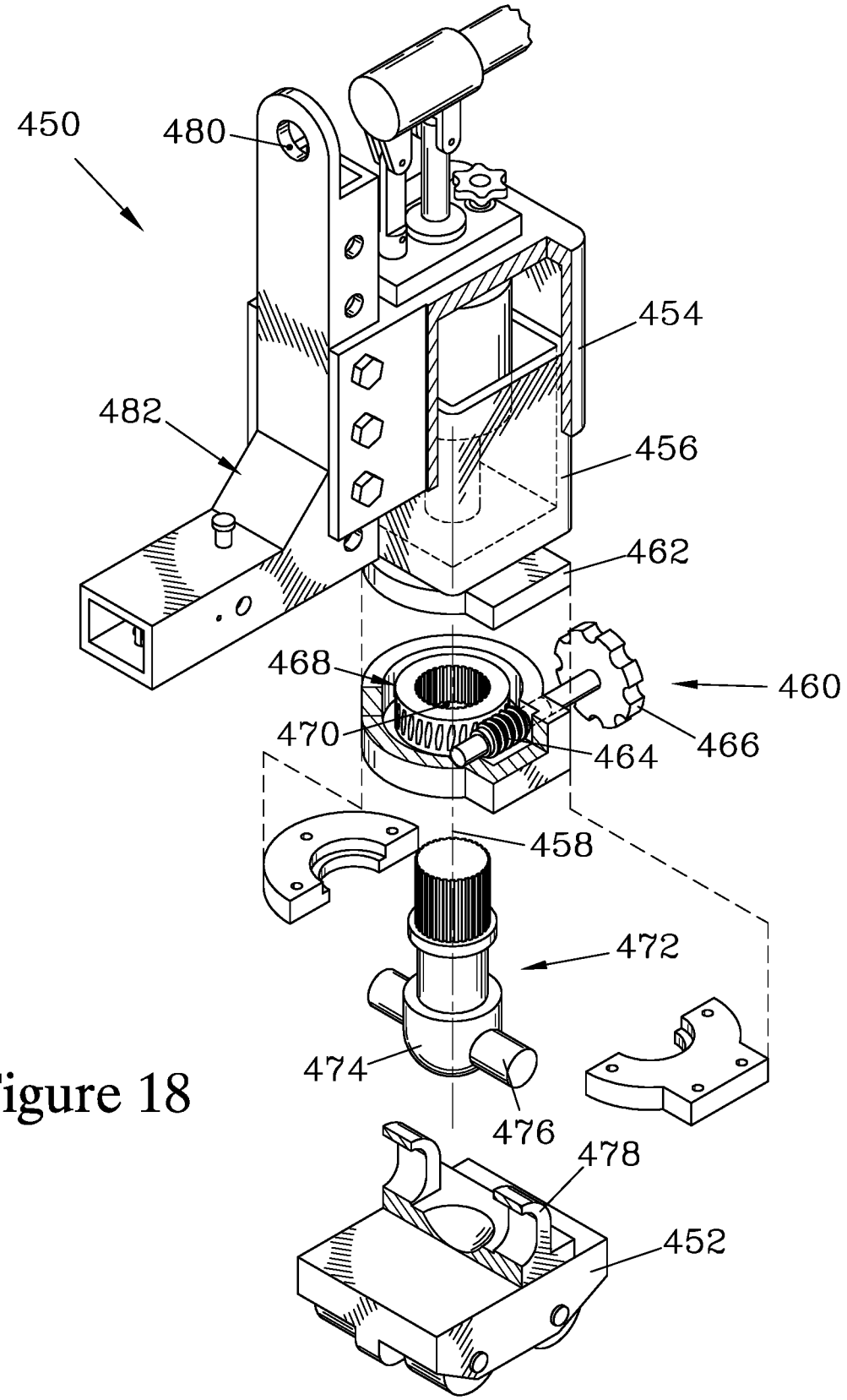
FIG. 18 illustrates a jack unit that employs a worm drive adjuster and a ball shaft to limit rotation of the skate.

FIG. 18 illustrates a jack unit 450 that employs another alternative scheme for limiting motion of a skate 452 with respect to a jack housing 454, where the jack housing 454 and an extendable element 456 are formed as square telescoping tubes that translate along a lift axis 458. In this embodiment, a worm drive adjuster 460 is provided between the skate 452 and the extendable element 456, and serves to adjust the orientation of the skate 452 about the lift axis 458 in a continuous manner.

The worm drive adjuster 460 is similar to those conventionally employed as slack adjusters, and has an adjuster housing 462 that is affixed to the extendable element 456, a worm screw 464 that is rotatably mounted in the adjuster housing 462 and can be manually rotated by a hand wheel 466, and a worm gear 468 that is mounted in the adjuster housing 462 and driven to rotate about the lift axis 458 by the worm screw 464 when the worm screw 464 is rotated. Typically, the engagement of the worm screw 464 and the worm gear 468 is such as to provide a reduction in the range of 30:1 to 40:1; this ratio is felt to provide a suitable balance between speed in adjusting the orientation of the skate 452 when changing directions and the ability to provide fine adjustment of the steering as well as sufficient resistance to prevent drifting of the alignment.

The worm gear 468 in turn has a splined passage 470 that transmits torque to a ball shaft 472 that has matching splines, and the ball shaft 472 terminates in a ball end 474 with a cross-pin 476. The ball end 474 and the cross-pin 476 engage a shaft mount 478 affixed onto the skate 452, in a similar manner to the ball shaft 412 and shaft mount 414 shown in FIGS. 15 and 16 and discussed above to allow a limited degree of tilting motion while blocking rotation about the lift axis 458. If it is desired to provide a jack unit that provides the skate with the capability to swivel freely when desired, the worm gear adjuster could be mounted to the extendable element via a lockable swivel, which could be similar to the locking swivel 410 discussed above for the embodiment shown in FIGS. 16 and 17.

The jack unit 450 also differs from the jack units discussed above in that it has a lift eye 480 that is provided on a jack extension 482, rather than on the jack housing 454. This positions the lift eye 480 closer to the object to which the jack unit 450 is attached, thereby reducing torques on the jack extension 482.

Figure 19:
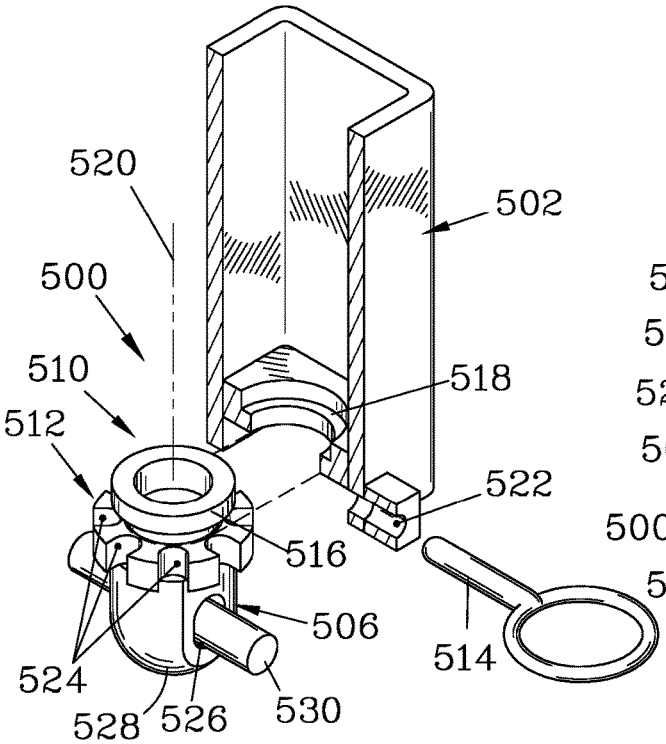
FIGS. 19-21 illustrate another alternative rotation-limiting structure, which employs a locking swivel and a ball shaft. An indexing plate is affixed to the ball shaft and rotatably mounted to the extendable element of the jack unit. The indexing plate has multiple recesses that accept a pin mounted to the extendable element.
Figure 20:
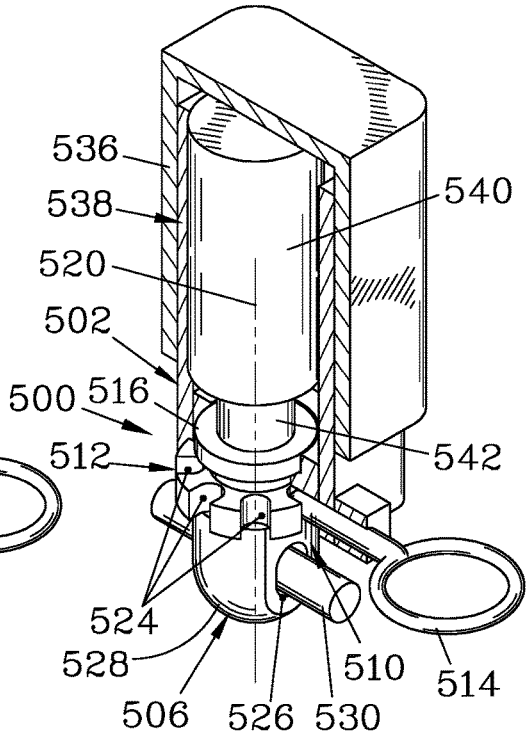
Figure 21:
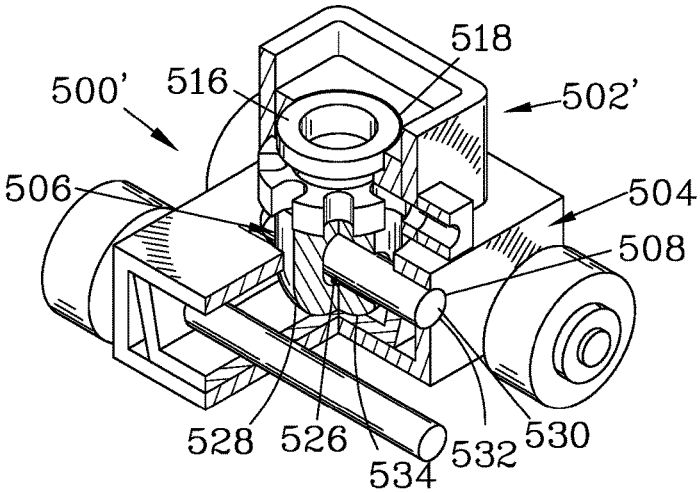

FIGS. 19-21 illustrate another motion-limiting structure 500 that can be employed to selectively limit rotation between an extendable element 502 of a jack unit and a skate 504 (shown in FIG. 21).

The motion limiting structure again employs a ball shaft 506 that engages a skate mounting structure 508 affixed to the skate 504, as well as a locking swivel 510 employing an indexing plate 512 engaged by an index pin 514. In the structure 500, the indexing plate 512 is affixed to the ball shaft 506, and the ball shaft 506 has a shaft swivel element 516 that pivotably engages a swivel seat 518 provided on the extendable element 512, so as to be rotatable about a vertical axis 520. The extendable element 502 is formed as a square tube, and the index pin 514 is slidably received in an index passage 522 in the extendable element 502. The index pin 514 can be advanced into one of eight index notches 524 in the indexing plate 512 when that index notch 524 is aligned with the index passage 522. When the index pin 514 is advanced into the index notch 524, it blocks rotation of the indexing plate 512, and the ball shaft 506 affixed thereto, with respect to the extendable element 502. The engagement between the ball shaft 506 and the skate mounting structure 508 blocks rotation of the skate 504 relative to the ball shaft 506 about the vertical axis 520, and thus the engagement of the index pin 514 with the indexing plate 512 serves to block rotation of the skate 504 relative to the extendable element 502 about the vertical axis 520. In turn, the extendable element 502 should be non-rotatably mounted with respect to the remainder of the jack unit, as discussed in greater detail below.

In the motion-limiting structure 500, the ball shaft 506 is provided with a vertically elongated slot 526 and a spherical support surface 528. A cross-pin 530 passes through the slot 526 and is retained in pin passages 532 provided in the skate 504, which serve in this embodiment as the skate mounting structure 508. The slot 526 limits the motion of the pin 530 passing therethrough to provide a limited degree of pitching motion and a much more limited degree of rolling motion of the skate 504 relative to the ball shaft 506. To support the ball shaft 506, the skate 504 is provided with a ball-engaging recess 534 that mateably engages the spherical support surface 528 of the ball shaft 506. Alternative structures for providing the desired motion between the ball shaft and the skate, such as shown in FIGS. 16-18, could alternatively be employed in the motion-limiting structure 500.

FIGS. 19 and 20 illustrate the motion-limiting structure 500 employed in a hydraulic jack unit, where the extendable element 502 slides within a square tube 536 that forms a part of a jack body. Examples of such jack units are shown in FIGS. 16-18, and the structure 500 should be adaptable to other hydraulic jack units. Extension and retraction of the extendable element 502 relative to the square tube 536 is controlled by a hydraulic cylinder 538 that is housed with the extendable element 502 and the square tube 536. The hydraulic cylinder 538 shown has a cylinder body 540 that is attached to the square tube 536, and an extendable cylinder shaft 542 that is attached to the shaft swivel element 516. Rotation of the cylinder shaft 542 in the cylinder body 540 allows rotation of the ball shaft 506 relative to the extendable element 502 and the square tube 536 when the index pin 514 is withdrawn from the index notch 524.

The motion limiting structure 500 is also well suited for use in a pneumatic jack unit, such as the jack unit 300 shown in FIGS. 14 and 15 or the jack unit 540 shown in FIG. 16. In this case of the jack unit 300, the square tube that forms the extendable element 502 could be substituted for the extendable element 312 shown in FIGS. 14 and 15. FIG. 21 illustrates the structure 500' when intended for use in an open-framed pneumatic jack unit such as the jack unit 540 shown in FIG. 22 and discussed below. In this case, the square tube forming the extendable element 502' is shortened, and could be affixed directly to the extendable element bottom brace 566.

The motion-limiting structures discussed above may provide a benefit when the jack units of the present invention are adapted for use in other lifting and moving applications. For example, a conventional adapter designed to engage the corner of a standard shipping container could be bolted to the jack housing in place of the jack extension. This modification would allow the modified jack units to lockably engage a shipping container to allow it to be lifted and moved on the skates attached to the jack units. In such an application, the ability to block rotation of the skates in a selected angular position would provide flexibility in moving the container in a desired direction while improving steering.

Figure 22:
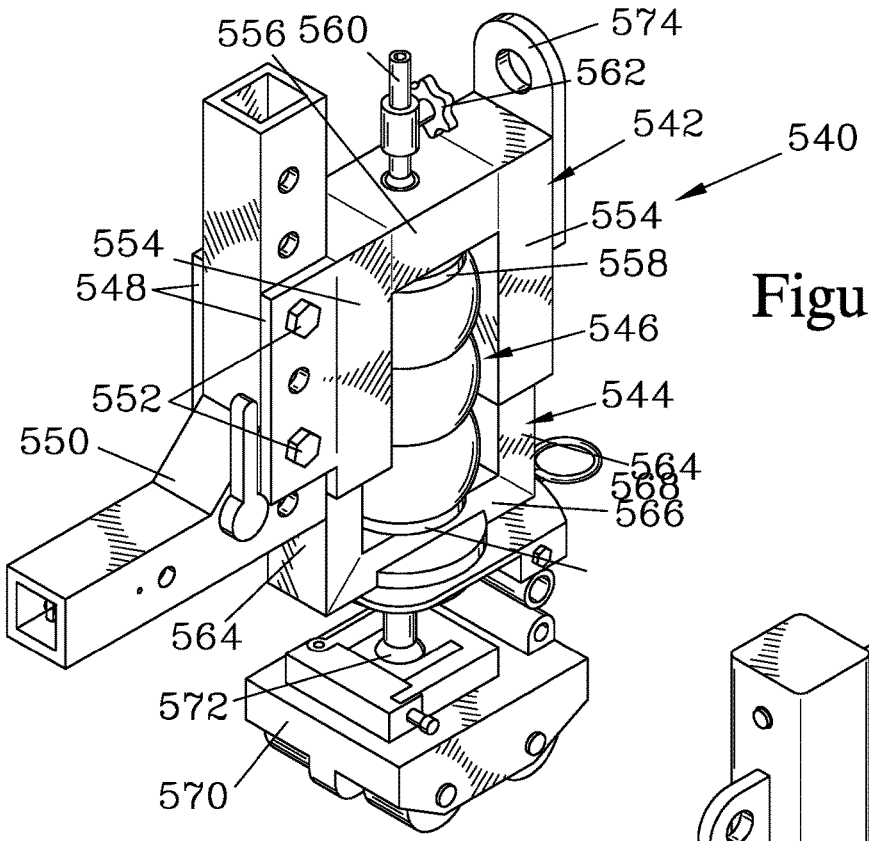
FIG. 22 is an isometric view of another pneumatic jack unit, which employs an open frame surrounding a pneumatic expansion element, allowing the jack housing to be readily fabricated from square tube stock.

FIG. 22 illustrates a jack unit 540 that is pneumatically operated, similarly to the jack unit 300 shown in FIGS. 14 and 15. The jack unit 540 has a jack housing 542 and an extendable element 544 that form a frame around an expandable expansion element 546. This configuration allows most components of the jack housing 542 and the extendable element 544 to be fabricated from readily available square tube stock. The jack housing 542 has a pair of mounting plates 548 to which a jack extension 550, fabricated from similar tube stock, can be affixed by bolts 552.

The jack housing 542 is formed by a pair of vertically-extending housing columns 554 connected together by a housing top brace 556, to which an upper end 558 of the expansion element 546 is attached. An air supply connector 560 is mounted to the housing top brace 556 and communicates with the expansion element 546 via an air valve 562 to allow connecting the expansion element 546 to a source of pressurized air. The pressure in the expansion element 546 can be adjusted to increase or decrease its height under a particular load to change the height of the extendable element 544 relative to the jack housing 542. Again, an air spring such as are employed in vehicle suspensions could be employed as the expansion element 546, and the use of a pneumatic expansion element 546 provides the jack unit 540 with a resilient response when traversing uneven surfaces.

The extendable element 544 has a pair of spaced apart extendable element columns 564 connected together by an extendable element bottom brace 566, and each of the extendable element columns 564 inserts into one of the housing columns 554 and is vertically movable therein to vary the separation between the housing top brace 556 and the extendable element bottom brace 566 as the expansion element 546 expands and contracts, while retaining the braces (556, 566) substantially parallel. The extendable element bottom brace 566 is attached to a lower end 568 of the expansion element 546, and is also attached to a skate 570 by a ball joint 572. The expansion element 546 should be securely attached to the housing top brace 556 and the extendable element bottom brace 566 to retain the extendable element 544 in the event that the jack unit 540 is lifted, such as by a crane attached to a lift eye 574 provided on the jack housing 542. For increased safety, an additional connection could be provided to maintain the extendable element 544 and the jack housing 542 engaged together at all times to prevent the extendable element 544 and the skate 570 from dropping, such as a slot cut in one of the extendable element columns that is engaged by the end of a bolt mounted in the corresponding housing column. The configuration of the jack housing 542 serves to place the lift eye 574 at a distance from the jack extension 550, serving to spread the locations at which lift straps are attached to the jack unit 540 to more easily clear a load to which the jack unit 540 is attached. However, such an extended position of the lift eye 547 increases the moment arm of torques on the jack extension 550.

Figure 23:
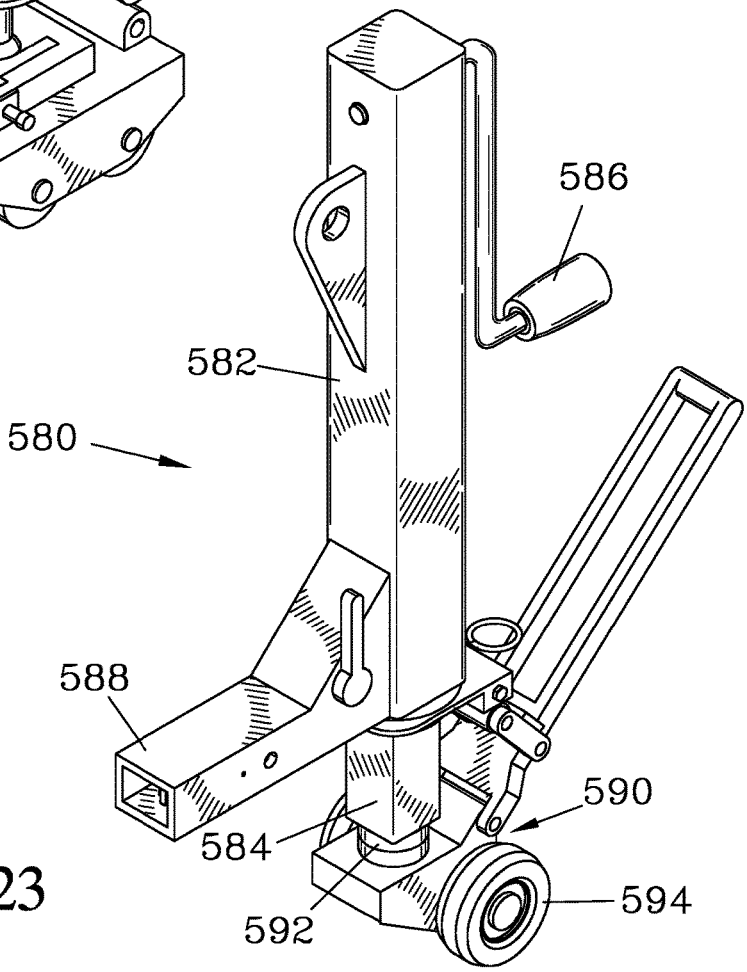
FIG. 23 is an isometric view illustrating one example of a jack unit designed for a particular application; this jack unit is intended for lifting and transporting small loads over surfaces susceptible to damage, and over surfaces having a large variation in height. Such uses include the installation and replacement of rooftop HVAC units and the installation of stone countertops, fireplaces, and other features in buildings having finished floor surfaces. The tongue is fixed to the jack housing, and a mechanical jack serves to extend and retract an extendable element. The use of a mechanical jack limits the load capacity and makes the system impractical for a single operator, but provides a long extension of the extendable element to allow greater lift height. The skate is provided with pneumatic wheels to accommodate uneven surfaces and reduce the risk of damage to the surface over which the jack unit traverses.

FIG. 23 illustrates a jack unit 580 that differs from the jack units discussed above in that it is designed for use lifting and moving relatively lightweight loads that must be raised a substantial distance. Examples of such situations include moving rooftop HVAC units, which typically must be placed on a raised platform having a height of about one foot above the surrounding roof surface, and installation of interior fixtures that must be moved up or down a staircase, and thus raised a sufficient height to clear one or more steps. The jack unit 580 has a jack housing 582 and an extendable element 584 formed by a conventional mechanical jack such as typically used with trailers. In such jacks, an internal gear mechanism (not shown) operates to extend and retract the extendable element 584 in response to operation of a manual crank 586. A tongue 588 is affixed directly to the jack housing 582, and a skate 590 is mounted to the extendable element 584 via a swivel joint 592. To avoid damage to an underlying surface and accommodate unevenness in the surface to be traversed, the skate 590 is provided with pneumatic wheels 594.

Figure 24:
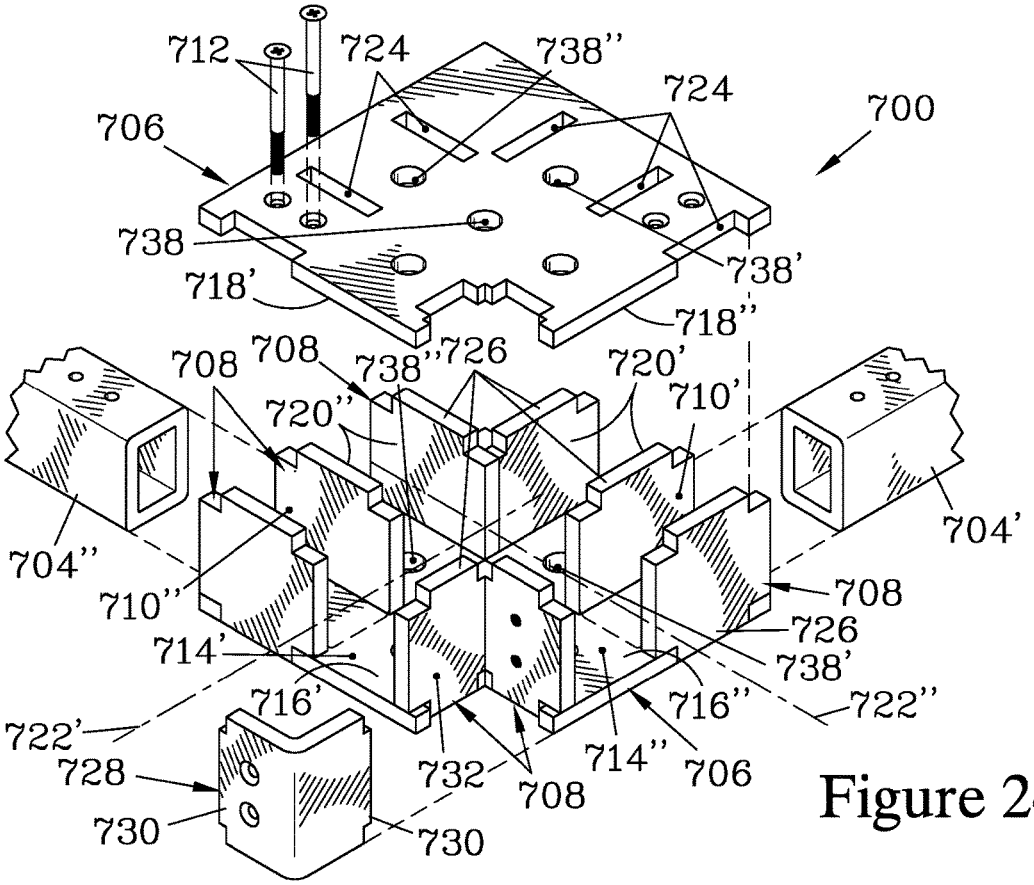
FIGS. 24-26 illustrate a coupling element that can be employed in place of those shown in FIGS. 1 and 10, as well as a freestanding frame that can be formed by connecting such coupling elements together with tubular frame members. The frame members can be cut to form a frame of the desired size for a particular object to be transported, and allow the frame to be assembled about the object. The coupling element is formed from pieces that attach together via tab-and-slot connections and form two coupling slots assembled, each slot being configured to latchably and supportably engage a tongue of a jack unit.
Figure 25:
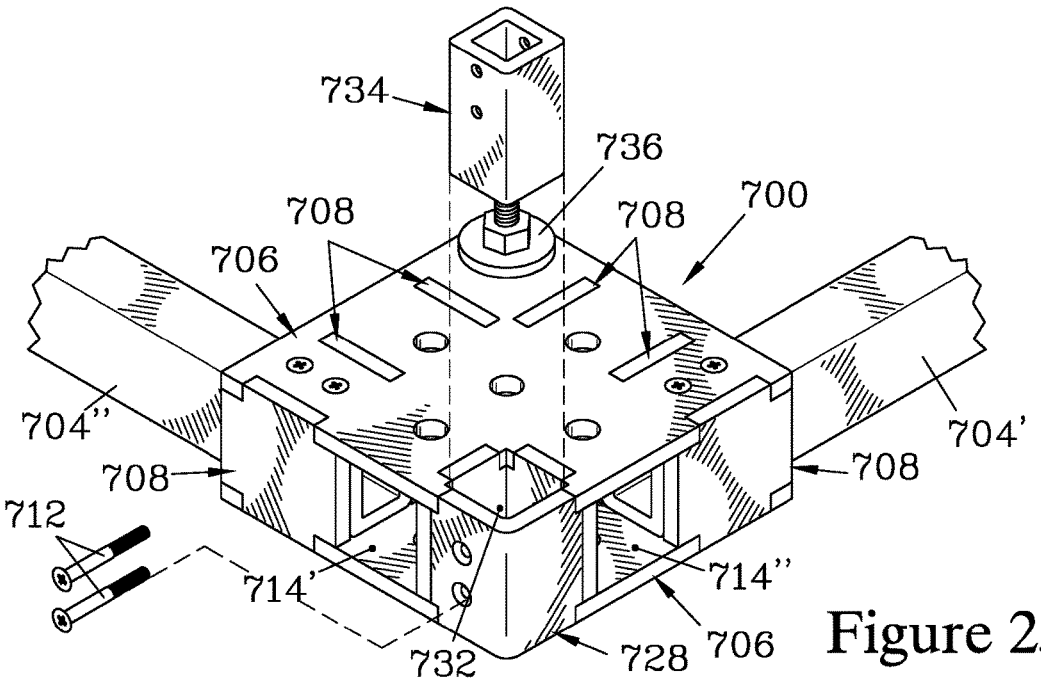
Figure 26:
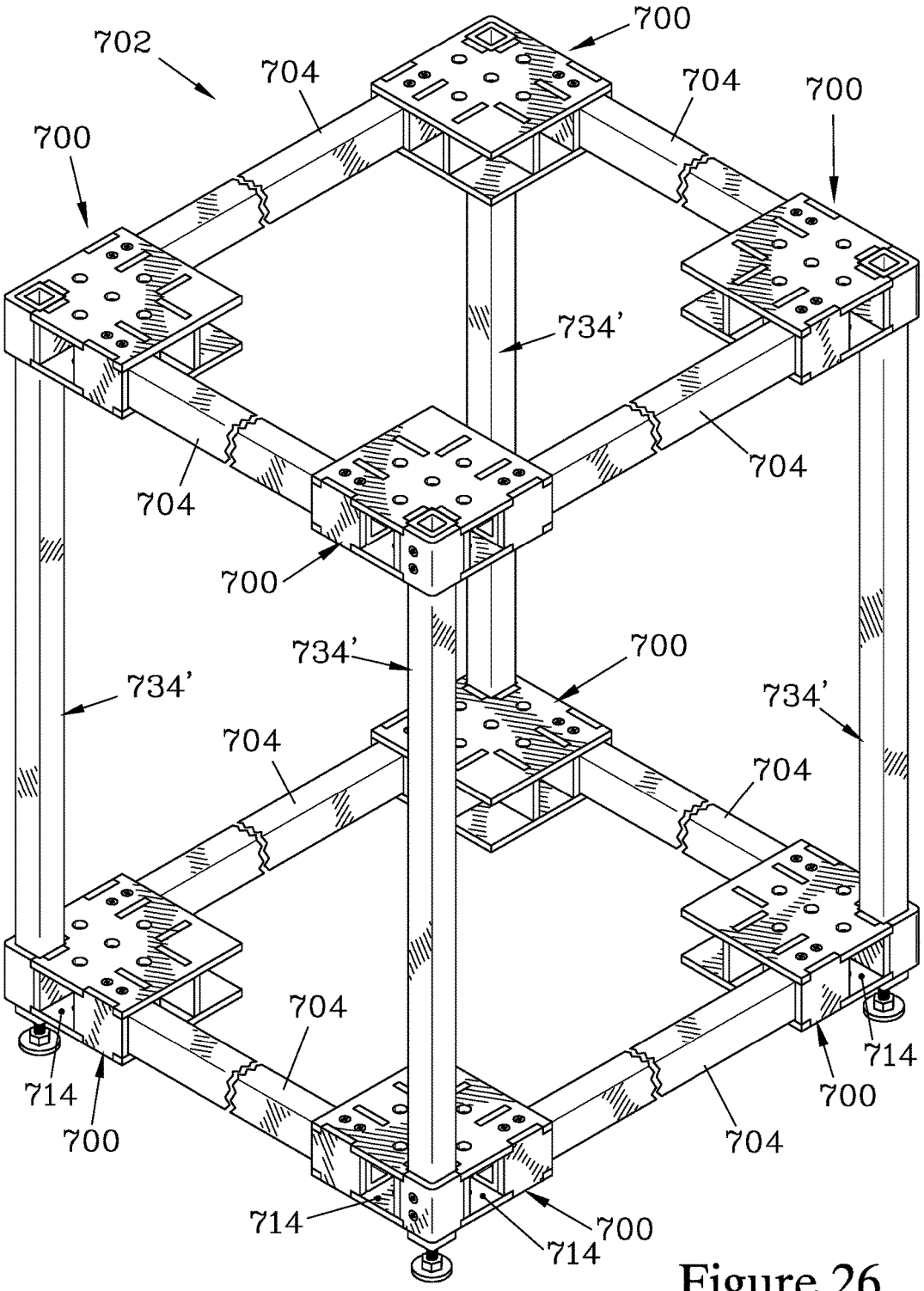

FIGS. 24 through 26 illustrate details of a coupling element 700 that can be secured to an object to allow attachment of a jack unit such as discussed above. The coupling element 700 could be attached directly to an object to me moved, or can be used to form a corner of a free-standing frame 702 (shown in FIG. 26) to which an object to be moved can be secured by bolts, strapping, or similar means known in the art. FIG. 24 illustrates the coupling element 700 partially exploded, while FIG. 25 illustrates the coupling element 700 assembled and engaged with two horizontal frame members 704.

The coupling element 700 has a pair of horizontal plates 706 that, when the coupling element 700, is assembled, are held apart by a series of vertical web members 708. The web members 708 are positioned and sized such that the assembled coupling element 700 is provided with outer channels 710 that are sized to slidably accept the frame members 704. Once inserted, bolts 712 can be used to affix the frame members 704 in place, as shown in FIG. 25. The web members 708 are further distributed so as to define two orthogonal, intersecting coupling slots (714', 714") for lockably accepting a tongue of a jack unit in the manner shown in FIG. 6 for the tongue 118 and coupling slot 122. Each coupling slot (714', 714") is bounded by a slot bottom wall (716', 716"), formed by one of the horizontal plates 706, a slot top wall (718', 718"), formed by the other plate 706, and opposed slot sidewalls (720', 720") formed by the web members 708. Providing a pair of coupling slots (714', 714") that extend orthogonally to each other allows a jack unit to be positioned either on the side or on the end of the frame 702. The walls (716, 718, and 720) of each of the coupling slots (714', 714") extend parallel to a horizontal axis (722', 722") of that coupling slot (714', 714"), and are configured to allow the tongue of a jack unit to be inserted along the horizontal axis (722', 722"), while limiting off-axis motion.

To facilitate fabrication, the horizontal plates 706 are provided with plate slots 724 (labeled in FIG. 24) and the web members 708 are provided with corresponding tabs 726 that are configured to engage the plate slots 724 to accurately position the web members 708 and to allow the components (706, 708) of the coupling element 700 to be assembled and then welded together without requiring any internal welds.

The coupling element 700 also includes a corner piece 728 formed of angle stock, which is provided with corner tabs 730 that are sized to fit between the plates 706 and abut against two of the web members 708. The corner piece 728, in combination with these two web members 708, forms a vertical frame member receptor 732 into which a vertical frame member 734 (shown in FIG. 25) can be secured with additional bolts 712. In FIG. 25, the vertical frame member 734 is formed as a leg, which is provided with a threadably adjustable foot 736. Alternatively, a longer vertical frame member having a series of passages for receiving bolts could be employed to allow the operator to adjust the extension of the vertical frame member below the coupling element 700 to provide a leg of a desired length. When it is desired for the frame 702 formed by the coupling elements 700 to either partially or entirely surround the object to be moved, a vertical frame member 734' can be employed that extends upwards from the coupling element 700, as shown in FIG. 26.

Using the coupling elements 700, the frame 702 can be readily formed in the desired size by cutting the frame members (704, 734') from conventional tubular stock to the desired lengths and then drilling them to accept the bolts 712. Furthermore, the frame 702 can be formed about the object to be moved while the object remains in position. Jack units such as those shown in FIGS. 1-23 can then be secured to the frame 702 by inserting the tongue of each jack unit into one of the coupling slots (714', 714") of one of the coupling elements 700. The coupling slots (714', 714") are each provided with one or more latch holes (738', 738") that serve as slot latching structures that can be engaged by a latch pin on the tongue of the jack unit to retain the tongue in the coupling slot (714', 714"). When the coupling slots (714', 714") intersect, one latch hole 738 may be usable by both coupling slots (714', 714").

Figure 27:
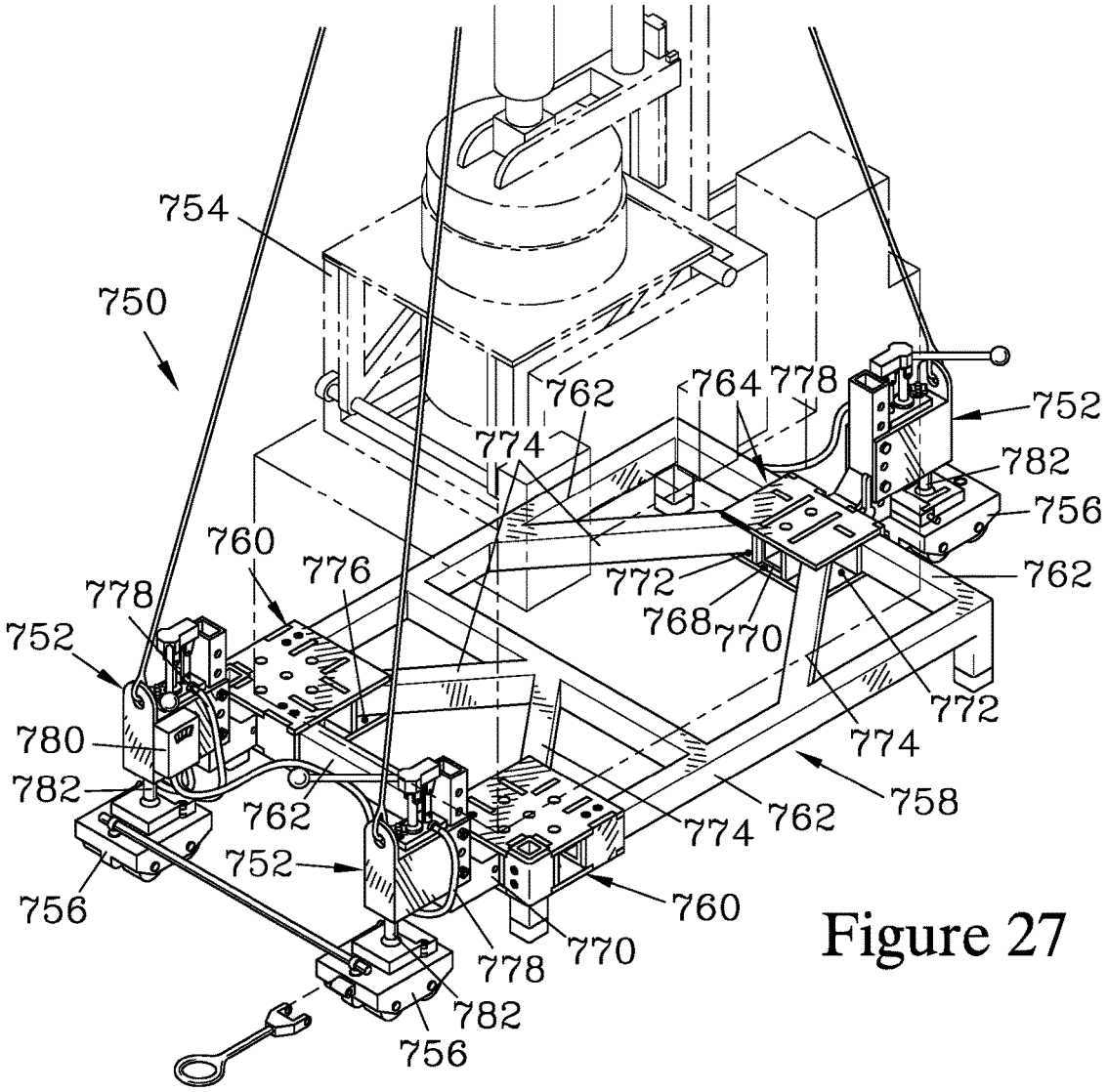
FIG. 27 is an isometric view illustrating another lifting and transporting system, which in this case employs only three jack units to support the object to be moved. This arrangement assures that all three of the skates bear a portion of the load at all times to preventing an overloading situation where the load is supported on only two skates. This system also has a pressure equalization system that communicates the hydraulic fluid pressure between all of the jack units.

FIG. 27 is an isometric view illustrating another embodiment of the present invention, a lifting and transporting system 750 that employs only three jack units 752 to support an object 754 (shown in phantom) to be lifted and transported. The use of only three jack units 752 assures that the weight of the load 754 is distributed at all times among the three jack units 752, providing the center of gravity of the object 754 falls within the triangle formed by the three jack units 752 and is reasonably centered; this avoids the possibility of a situation in which, due to unevenness of a surface being traversed, the object 754 becomes supported on only two jack units 752, which could result in overloading of the jack units 752. The jack units 752 are flexibly attached to skates 756, and are lockably engaged to a frame 758 to which the load 754 is affixed.

Figure 28:
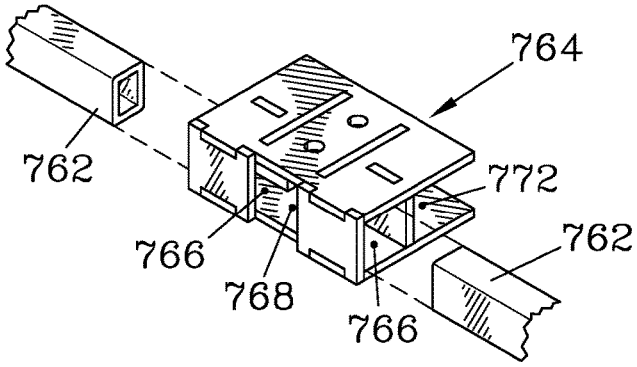
FIG. 28 shows a side coupling element employed in this system, which only has one slot for accepting the tongue of one of the jack units.

The frame 758 of this embodiment is a welded frame with two corners formed by corner coupling elements 760 (which are similar to the coupling elements 700 shown in FIGS. 24-26), while the remaining two corners are formed by directly joining together frame members 762. The frame members 762 are also welded to a side coupling element 764 that provides an attachment point for the third jack 752. The side coupling element 764 is better shown in FIG. 28, and has a pair of opposed channels 766, each of which can slidably accept one of the frame members 762. The channels 766 bracket a single coupling slot 768, which is configured to lockably accept a tongue 770 (shown in FIG. 27) of one of the jack units 752. The side coupling element 764 also has a pair of inner corner pockets 772, into which supplemental frame members 774 can be welded to provide diagonal supports, as shown in FIG. 27. Similarly, supplemental frame members 774 are inserted into an inner corner pocket 776 formed in each of the corner coupling elements 760, providing greater rigidity for the frame 758, as well as serving to brace the coupling elements 760 against torques imparted by the jack units 752 when supporting especially heavy loads. The side coupling element 764 could also be employed in situations where it is desired to form an elongated frame with locations along the sides of the frame to attach additional jack units in order to better distribute the weight of an elongated load.

The system 750 also differs from the systems discussed earlier in that the jack units 752 are connected together by hydraulic lines 778 and a hydraulic controller 780 that equalize the pressure between the three jack units 752, to coordinate the extension of their extendable elements 782. This coordination allows the jack units 752 to lift the object 754 in a coordinated manner to maintain the object 754 level and avoid tipping, and allow the system 750 to be operated by an individual. When the hydraulic controller 780 includes a pressure gauge, the weight of the object 754 can be calculated based on the indicated pressure. It should be appreciated that the weight of the load supported by any system of the present invention that employs hydraulic jack units could alternatively be calculated by use of pressure gauges associated with each of the individual jack units.

FIGS. 29 and 30 illustrate a coupling element 800 formed by a pair of horizontal plates 802 connected together by a series of vertical web members 804. The web members 804 are configured to form three coupling slots (806', 806", 806'"), arranged at 45 angles. This allows a jack unit 808 (shown in FIG. 30) to be attached to the coupling element 800 either alongside a load to which the coupling element 800 is attached, in-line with the load, or at an intermediate 45 position extending radially outward from the load; this latter position should provide enhanced stability in cases where the load must be moved along a path where the direction of travel changes multiple times.

Each of the coupling slots 806 is bounded by a slot lower bearing surface 810, formed by one of the horizontal plates 802, a slot upper bearing surface 812, formed by the other plate 802, and opposed slot side bearing surfaces 814 formed by the web members 804. For each coupling slot (806', 806", 806'"), the bearing surfaces (810, 812, 814) extend parallel to a horizontal axis (816', 816", 816'"), where a first horizontal axis 816' and a second horizontal axis 816" are orthogonal, while a third horizontal axis 816'" is oriented at a 45 angle to the other two horizontal axes (816', 816').

The web members 804 are further configured to provide the coupling element 800 with two outer channels 818 that are each sized to slidably accept a frame members that can be welded in place after installation.

FIG. 30 shows the coupling element 800 and the jack unit 808 when a tongue 820 has been inserted into and lockably engaged with the third coupling slots 806'" that is oriented at a 45 angle with respect to the other two coupling slots (806', 806"). The jack unit 808 illustrated is similar to the hydraulic jack unit shown in FIGS. 19 and 20, controlling the height of the tongue 820 by extension and retraction of a hydraulic cylinder 822. The extension of the cylinder 822 is controlled by a pump 824 that communicates with the cylinder 822 via a fluid manifold 826. The pump 824 also connects to a fluid reservoir 828, and can be operated to increase the fluid pressure in the cylinder 822. The pressure can be reduced by operation of a release valve 830.

To provide a resilient response similar to that offered by pneumatic jack units, the fluid manifold 826 also provides communication between the cylinder 822 and a hydraulic accumulator 832. The hydraulic accumulator 832 provides a reserve pressure to maintain the extension of the cylinder 822 to maintain a relatively even lifting force in the event that a skate 834 mounted to the jack unit 808 encounters a depression in the surface being traversed. The hydraulic accumulator 832 acts to pressurize the cylinder 822 and thereby dampen the effect of the release of pressure that would otherwise occur, thereby allowing a load attached to the coupling element 800 to traverse an uneven surface while maintaining the load horizontally level within a specified tolerance. Thus, the use of the hydraulic accumulator 832 provides the jack unit 808 with a damped response to impacts, similar to that offered by pneumatic jack units, but while maintaining a greater load capacity.

As with earlier embodiment, the tongue 820 can be secured in one of the coupling slots (806', 806", 806') by a latch pin (not shown) that engages a latch hole (836', 836", 836'") provided in the coupling slot (806', 806", 806'").

FIG. 31 illustrates a lifting and transporting system 900 having a frame 902 that has been adapted to provide improved maneuverability in confined spaces. The system 900 is designed for use with relatively light, compact loads, and employs four jack units 904 that employ pneumatic jacks similar to the jack unit 500 shown in FIG. 20. The frame 902 is formed from coupling elements 906 that serve as corners that connect together frame members 908 in a manner similar to that of the coupling elements 700 and frame members 704 of the frame 702 shown in FIG. 26. The frame 902 differs in that it is provided with supplementary wheel attachments 910 that are attached to two of the frame members 908 prior to assembly of the frame 902. One of these supplementary wheel attachments 910 is better shown in FIG. 32.

The supplementary wheel attachment 910 has a tubular sleeve 912 sized to slide over the frame member 908, and has a pair of axle supports 914 affixed thereto so as to reside below the tubular sleeve 912. A supplementary wheel 916 is mounted to an axle 918 that in turn is mounted between the axle supports 914 in such a manner that the supplementary wheel 916 can rotate about a supplementary wheel axis 920 that is orthogonal to a longitudinal axis 922 of the tubular sleeve 912. A set bolt 924 is mounted through the tubular sleeve 912 and can be threadably advanced to lock against the frame member 909 to fix the supplementary wheel attachment 910 in a desired position.

The supplementary wheels 916 attached to the frame 902 can be activated or deactivated by raising and lowering the jack units 904 relative to skates 926 attached thereto. In the system 900, the skates 926 are provided with caster wheels 928. When the jack units 904 are lowered to an extent that the supplementary wheels 916 extend below a plane on which the caster wheels 928 reside, the frame 902 is supported in the middle on the supplementary wheels 916 and at one end by the caster wheels 928 of the pair of skates 926 at that end. Since the caster wheels 928 are free to move in any direction, the operator can readily maneuver the system 900 by turning it at the location of the supplementary wheels 916. When it is desired to deactivate the supplementary wheels 916, to support the frame 902 at its ends rather than at the center and one end, the operator can activate the jack units 904 to raise the frame 902, and the supplementary wheel attachments 910 that are mounted thereon, to an elevation sufficient that the supplementary wheels 916 are raised off the underlying surface.

The modular construction of the frames made using the coupling elements of the present invention allows additional elements to be readily added in a similar manner to the supplementary wheel attachments 910 discussed above. Two examples of such attachments are shown in FIGS. 33 and 34 and discussed below.

FIG. 33 illustrates a forklift pocket attachment 950 that could be attached to a frame to provide structure to allow the frame to be readily transported by a forklift. Again, the forklift pocket attachment 950 has a tubular body 952 sized to slide over a frame member, and has a pair of set bolts 954 that can be threadably advanced through the tubular body 952 to lock against the frame member inserted therethrough. The set bolts 954 fix the forklift pocket attachment 950 in place to prevent slippage in use. The forklift pocket attachment 950 has a pair of tine pockets 956 affixed to the tubular body 952 so as to reside below the tubular body 952. The tine pockets 956 are configured to be engaged by the tines of a conventional forklift (not shown) to allow the forklift to pick up the frame to which the forklift pocket attachment 950 is affixed. While the attachment 950 has a pair of tine pockets 956, a pair of attachments each having a single tine pocket could be employed.

FIG. 34 illustrates an anchor point attachment 970 that provides an anchor slot 972 for attaching a strap to secure an object to a frame on which the anchor point attachment 970 is mounted. Again, the anchor point attachment 970 has a tubular body 974 configured to slidably engage a frame member prior to assembly of the frame, and a set bolt 976 that can be advanced to lock the tubular body 974 in place at a desired location.

Figure 35:
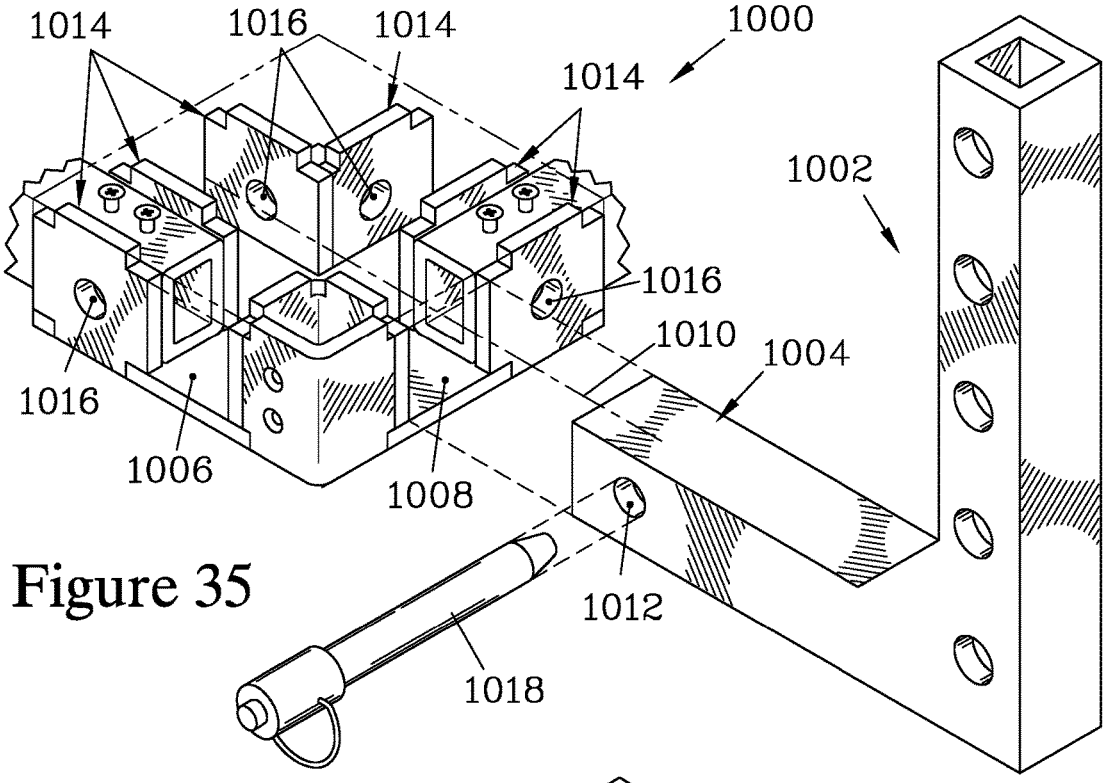
FIGS. 35 and 36 illustrate a coupling element of the present invention that is similar to the coupling element shown in FIGS. 24-26, but which employs a different tongue latching structure for securing a tongue of a jack unit to retain it engaged in one of the coupling slots. The top plate of the coupling element is shown in phantom to better show the structure.
Figure 36:
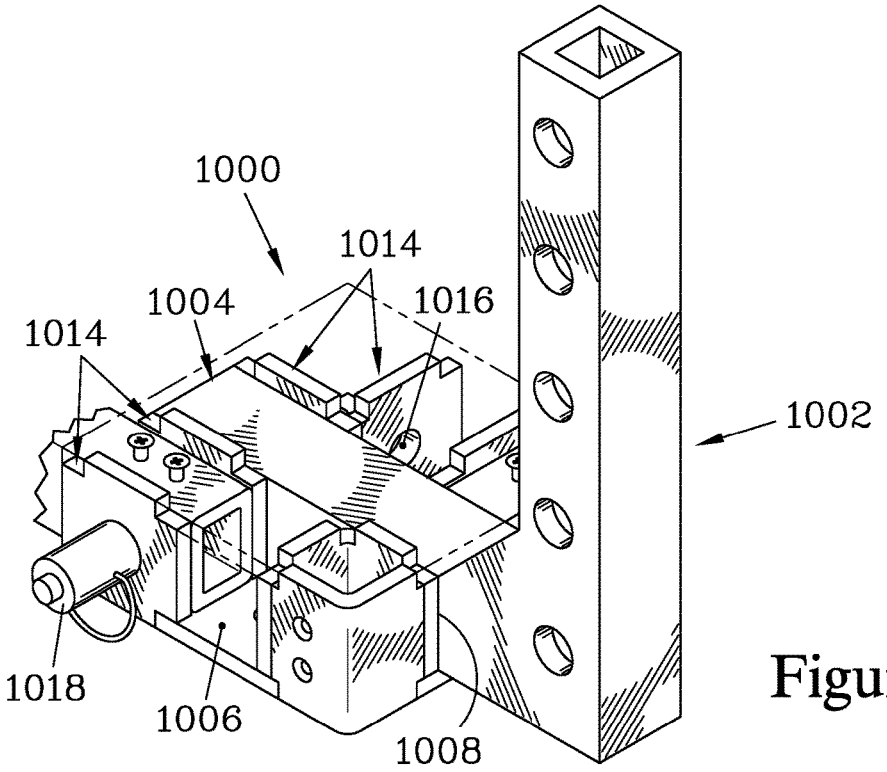

FIGS. 35 and 36 illustrate an alternative coupling element 1000 that is similar to the coupling element 700 shown in FIGS. 24-26, but which is designed for use with a jack extension 1002 that employs a different tongue latching structure for securing a tongue 1004 in one of two orthogonal, intersecting coupling slots (1006, 1008) provided in the coupling element 1000. Again, the coupling element 1000 could be attached directly to an object to be moved, or could be used to form a corner of a frame to which the object to be moved can then be secured, and again each of the slots (1006, 1008) is configured to slidably engage the tongue 1004 so as to limit relative motion therebetween to translation along a tongue axis 1010.

The tongue 1004 lacks an internal latching structure as employed in the embodiments discussed above. Instead, the tongue 1004 is provided with a tongue latch pin passage 1012, and selected vertical web members 1014 of the coupling element 1000 are provided with slot latch pin passages 1016. When the tongue 1004 is inserted into one of the coupling slots (1006, 1008), as shown in FIG. 36 for the coupling slot 1008, the tongue latch pin passage 1012 can be aligned with the slot latch pin passages 1016 for that coupling slot (1006, 1008), allowing a latch pin 1018 to be inserted through the aligned passages (1012, 1016) to block axial motion of the tongue 1004 in the slot (1006, 1008), thereby retaining the jack extension 1002 rigidly engaged with the coupling element 1000. This alternative scheme for securing the tongue 1004 engaged with the coupling element 1000 has been found particularly suitable for lighter weight applications, and applications where the object need not be suspended during the moving operation.

While the novel features of the present invention have been described in terms of particular embodiments and preferred applications, it should be appreciated by one skilled in the art that substitution of materials and modification of details can be made without departing from the spirit of the invention.

What is claimed is:

1. A coupling element for attachment to an object to be lifted and transported by jack units, each of the jack units having, a skate, a tongue extending along a tongue axis and vertically movable relative to the skate, the tongue having, a tongue upper bearing surface extending parallel to the tongue axis, a tongue lower bearing surface extending parallel to the tongue axis, a pair of opposed tongue side bearing surfaces extending parallel to the tongue axis, and a selectively releasable tongue latching structure, and the coupling element comprising:

a first coupling slot extending along a first slot axis and configured to slidably accept the tongue of one of the jack units, said first coupling slot having, a downward-facing first slot upper bearing surface extending parallel to the first slot axis and configured to slidably and supportably engage the tongue upper bearing surface, said first slot upper bearing surface having a length extending parallel to the first slot axis that is greater than a width extending orthogonally with respect to the first slot axis, an upward-facing first slot lower bearing surface extending parallel to the first slot axis and configured to slidably and supportably engage the tongue lower bearing surface, said first slot lower bearing surface having a length extending parallel to the first slot axis that is greater than a width extending orthogonally with respect to the first slot axis, a pair of oppositely-facing first slot side bearing surfaces extending parallel to the first slot axis and configured to slidably and supportably engage the tongue side bearing surfaces, said first slot side bearing surfaces each having a length extending parallel to the first slot axis that is greater than a height extending orthogonally with respect to the first slot axis, and a first slot latching structure configured to be releasably engaged with the tongue latching structure when the tongue upper, lower, and side bearing surfaces are engaged with said first slot upper, lower, and side bearing surfaces, such engagement by said tongue latching structure acting to block slidable motion between the tongue upper, lower, and side bearing surfaces and said first slot upper, lower, and side bearing surfaces; and a second coupling slot extending along a second slot axis that is orthogonal to the first slot axis, said second coupling slot configured to slidably accept the tongue of one of the jack units and having, a downward-facing second slot upper bearing surface extending parallel to the second slot axis and configured to slidably and supportably engage the tongue upper bearing surface, said second slot upper bearing surface having a length extending parallel to the second slot axis that is greater than a width extending orthogonally with respect to the second slot axis, an upward-facing second slot lower bearing surface extending parallel to the second slot axis and configured to slidably and supportably engage the tongue lower bearing surface, said second slot lower bearing surface having a length extending parallel to the second slot axis that is greater than a width extending orthogonally with respect to the second slot axis, a pair of oppositely-facing second slot side bearing surfaces extending parallel to the second slot axis and configured to slidably and supportably engage the tongue side bearing surfaces, said second slot side bearing surfaces each having a length extending parallel to the second slot axis that is greater than a height extending orthogonally with respect to the second slot axis, and a second slot latching structure configured to be releasably engaged with the tongue latching structure when the tongue upper, lower, and side bearing surfaces are engaged with said second slot upper, lower, and side bearing surfaces, such engagement by said tongue latching structure acting to block slidable motion between the tongue upper, lower, and side bearing surfaces and said second slot upper, lower, and side bearing surfaces.

2. The coupling element of claim 1 wherein said first coupling slot and said second coupling slot intersect and extend through each other.

3. The coupling element of claim 2 wherein the tongue latching structure of each of the jack units is a retractable latching pin mounted in the tongue so as to selectively protrude therefrom and further wherein, said first slot latching structure is provided by at least one first slot latch hole which is positioned to receive the retractable latching pin when the tongue is inserted into said first coupling slot; and said second slot latching structure is provided by at least one second slot latch hole which is positioned to receive the retractable latching pin when the tongue is inserted into said second coupling slot.

4. The coupling element of claim 3 wherein said first slot latching structure is provided by a plurality of first slot latch holes, each of which is positioned to receive the retractable latching pin when the tongue is inserted into said first coupling slot to a particular depth; and further wherein said second slot latching structure is provided by a plurality of second slot latch holes, each of which is positioned to receive the retractable latching pin when the tongue is inserted into said second coupling slot to a particular depth.

5. The coupling element of claim 4 wherein one of said first slot latch holes is positioned to also serve as one of said second slot latch holes.

6. The coupling element of claim 3 wherein said at least one first slot latch hole includes at least one first slot latch hole in each of said first slot upper bearing surface and said first slot lower bearing surface; and further wherein said at least one second slot latch hole includes at least one second slot latch hole in each of said second slot upper bearing surface and said second slot lower bearing surface.

7. The coupling element of claim 1 wherein the coupling element is configured to accept elongated frame members so as to form a corner of a rigid frame, the coupling element further comprising:

a first frame member receptor extending along a first receptor axis that is parallel to the first slot axis, said first frame member receptor being configured to slidably accept an elongated first frame member and to engage the first frame member so as to prevent off-axis motion between the coupling element and the first frame member; and a second frame member receptor extending along a second receptor axis that is parallel to the second slot axis, said second frame member receptor being configured to slidably accept an elongated second frame member and to engage the second frame member so as to prevent off-axis motion between the coupling element and the second frame member.

8. The coupling element of claim 7 further comprising:

a third frame member receptor extending along a third receptor axis that is orthogonal to the first receptor axis and to the second receptor axis, said third frame member receptor being configured to slidably accept an elongated third frame member and to engage the third frame member so as to prevent off-axis motion between the coupling element and the third frame member.

9. The coupling element of claim 1 further comprising:

a third coupling slot extending along a third slot axis that is inclined by 45° to the first slot axis and to the second slot axis, said third coupling slot configured to slidably accept the tongue of the jack unit and having, a downward-facing third slot upper bearing surface extending parallel to the third slot axis and configured to slidably and supportably engage the tongue upper bearing surface, said third slot upper bearing surface having a length extending parallel to the third slot axis that is greater than a width extending orthogonally with respect to the third slot axis, an upward-facing third slot lower bearing surface extending parallel to the third slot axis and configured to slidably and supportably engage the tongue lower bearing surface, said third slot lower bearing surface having a length extending parallel to the third slot axis that is greater than a width extending orthogonally with respect to the third slot axis, a pair of oppositely-facing third slot side bearing surfaces extending parallel to the third slot axis and configured to slidably and supportably engage the tongue side bearing surfaces, said third slot side bearing surfaces each having a length extending parallel to the third slot axis that is greater than a height extending orthogonally with respect to the third slot axis, and a third slot latching structure configured to be releasably engaged with the tongue latching structure when the tongue upper, lower, and side bearing surfaces are engaged with said third slot upper, lower, and side bearing surfaces, such engagement by the tongue latching structure acting to block slidable motion between the tongue upper, lower, and side bearing surfaces and said third slot upper, lower, and side bearing surfaces.

10. The coupling element of claim 9 for use when the tongue latching structure of each of the jack units is a retractable latching pin mounted in the tongue so as to selectively protrude therefrom, wherein:

said first slot latching structure is provided by at least one first slot latch hole which is positioned to receive the retractable latching pin when the tongue is inserted into said first coupling slot;

said second slot latching structure is provided by at least one second slot latch hole which is positioned to receive the retractable latching pin when the tongue is inserted into said second coupling slot; and said third slot latching structure is provided by at least one third slot latch hole which is positioned to receive the retractable latching pin when the tongue is inserted into said third coupling slot.

11. The coupling element of claim 10 wherein said first slot latching structure is provided by a plurality of first slot latch holes, each of which is positioned to receive the retractable latching pin when the tongue is inserted into said first coupling slot to a particular depth;

further wherein said second slot latching structure is provided by a plurality of second slot latch holes, each of which is positioned to receive the retractable latching pin when the tongue is inserted into said second coupling slot to a particular depth; and yet further wherein said third slot latching structure is provided by a plurality of third slot latch holes, each of which is positioned to receive the retractable latching pin when the tongue is inserted into said third coupling slot to a particular depth, one of said first slot latch holes being positioned to also serve as one of said second latch holes and as one of said third latch holes.

12. A coupling element for attachment to an object to be lifted and transported by jack units, each of the jack units having, a skate, a tongue extending along a tongue axis and vertically movable relative to the skate, the tongue having tongue bearing surfaces that extend parallel to the tongue axis, and a selectively releasable tongue latching structure, and the coupling element comprising:

a first coupling slot extending along a first slot axis and configured to slidably accept the tongue of one of the jack units, said first coupling slot having first slot bearing surfaces configured to slidably and supportably engage the tongue bearing surfaces so as to limit motion therebetween to translation along the first slot axis, said first coupling slot having a depth extending along the first slot axis that is greater than both a height extending orthogonally with respect to the first slot axis and a width extending orthogonally with respect to the first slot axis;

a first slot latching structure configured to be releasably engaged by the tongue latching structure when the tongue bearing surfaces are engaged with said first slot bearing surfaces, such engagement of the tongue latching structure with said first slot latching structure acting to block slidable motion between the tongue bearing surfaces and said first slot bearing surfaces;

a second coupling slot extending along a second slot axis that is orthogonal to the first slot axis and configured to slidably accept the tongue, said second coupling slot having second slot bearing surfaces configured to slidably and supportably engage the tongue bearing surfaces so as to limit motion therebetween to translation along the second slot axis, said second coupling slot having a depth extending along the second slot axis that is greater than both a height extending orthogonally with respect to the second slot axis and a width extending orthogonally with respect to the second slot axis; and a second slot latching structure configured to be releasably engaged by the tongue latching structure when the tongue bearing surfaces are engaged with said second slot bearing surfaces, such engagement of the tongue latching structure with said second slot latching structure acting to block slidable motion between the tongue bearing surfaces and said second slot bearing surfaces.

13. The coupling element of claim 12 wherein said first coupling slot and said second coupling slot intersect and extend through each other.

14. The coupling element of claim 13 wherein the tongue latching structure of each of the jack units is a retractable latching pin mounted in the tongue so as to selectively protrude therefrom and, said first slot latching structure is provided by at least one first slot latch hole which is positioned to receive the retractable latching pin when the tongue is inserted into said first coupling slot; and said second slot latching structure is provided by at least one second slot latch hole which is positioned to receive the retractable latching pin when the tongue is inserted into said second coupling slot.

15. The coupling element of claim 14 wherein said first slot latching structure is provided by a plurality of first slot latch holes, each of which is positioned to receive the retractable latching pin when the tongue is inserted into said first coupling slot to a particular depth; and further wherein said second slot latching structure is provided by a plurality of second slot latch holes, each of which is positioned to receive the retractable latching pin when the tongue is inserted into said second coupling slot to a particular depth.

16. The coupling element of claim 15 wherein one of said first slot latch holes is positioned to also serve as one of said second latch holes.

17. The coupling element of claim 14 wherein said at least one first slot latch hole includes at least one pair of opposed first slot latch holes positioned to receive the retractable latching pin when the tongue is inserted into said first coupling slot in either a first orientation or in a second orientation that is inverted from the first orientation; and further wherein said at least one second slot latch hole includes at least one pair of opposed second slot latch holes positioned to receive the retractable latching pin when the tongue is inserted into said second coupling slot in either the first orientation or in the second orientation.

18. The coupling element of claim 12 wherein the coupling element is configured to accept elongated frame members so as to form a corner of a rigid frame, the coupling element further comprising:

a first frame member receptor extending along a first receptor axis that is parallel to the first horizontal axis, said first frame member receptor being configured to slidably accept an elongated first frame member and to engage the first frame member so as to prevent off-axis motion between the coupling element and the first frame member; and a second frame member receptor extending along a second receptor axis that is parallel to the second horizontal axis, said second frame member receptor being configured to slidably accept an elongated second frame member and to engage the second frame member so as to prevent off-axis motion between the coupling element and the second frame member.

19. The coupling element of claim 18 further comprising:

a third frame member receptor extending along a vertical third receptor axis that is orthogonal to the first receptor axis and to the second receptor axis, said third frame member receptor being configured to slidably accept an elongated third frame member and to engage the third frame member so as to prevent off-axis motion between the coupling element and the third frame member.

20. The coupling element of claim 12 further comprising:

a third coupling slot extending along a third slot axis that is inclined by 45° to the first slot axis and to the second slot axis, said third coupling slot configured to slidably accept the tongue of the jack unit and having third slot bearing surfaces configured to slidably and supportably engage the tongue bearing surfaces so as to limit motion therebetween to translation along the third slot axis, said third coupling slot having a depth extending along the third slot axis that is greater than both a height extending orthogonally with respect to the third slot axis and a width extending orthogonally with respect to the third slot axis; and a third slot latching structure configured to be releasably engaged by the tongue latching structure when the tongue bearing surfaces are engaged with said third slot bearing surfaces, such engagement of the tongue latching structure with said third slot latching structure acting to block slidable motion between the tongue bearing surfaces and said third slot bearing surfaces.

21. The coupling element of claim 20 for use when the tongue latching structure of each of the jack units is a retractable latching pin mounted in the tongue so as to selectively protrude therefrom, wherein:

said first slot latching structure is provided by at least one first slot latch hole which is positioned to receive the retractable latching pin when the tongue is inserted into said first coupling slot;

said second slot latching structure is provided by at least one second slot latch hole which is positioned to receive the retractable latching pin when the tongue is inserted into said second coupling slot; and said third slot latching structure is provided by at least one third slot latch hole which is positioned to receive the retractable latching pin when the tongue is inserted into said third coupling slot.

22. The coupling element of claim 21 wherein said first slot latching structure is provided by a plurality of first slot latch holes, each of which is positioned to receive the retractable latching pin when the tongue is inserted into said first coupling slot to a particular depth;

further wherein said second slot latching structure is provided by a plurality of second slot latch holes, each of which is positioned to receive the retractable latching pin when the tongue is inserted into said second coupling slot to a particular depth; and yet further wherein said third slot latching structure is provided by a plurality of third slot latch holes, each of which is positioned to receive the retractable latching pin when the tongue is inserted into said third coupling slot to a particular depth, one of said first slot latch holes being positioned to also serve as one of said second latch holes and as one of said third latch holes.

* * * * *